United States Patent [19]

Brown, deceased et al.

[11] 4,013,178

[45] Mar. 22, 1977

[54] PIPE RACKER

[76] Inventors: Cicero C. Brown, deceased, late of Houston, Tex.; by Joe R. Brown, executor, P.O. Box 19236, Houston, Tex. 77024

[22] Filed: Jan. 17, 1975

[21] Appl. No.: 541,709

[52] U.S. Cl. ..... 214/2.5; 294/102 A

[51] Int. Cl.[2] ..... E21B 19/00

[58] Field of Search ..... 214/2.5, 1 BT, 1 BB; 294/102 A

[56] References Cited

UNITED STATES PATENTS

| | | | |
|---|---|---|---|
| 1,502,628 | 7/1924 | Hanna | 294/102 A |
| 2,700,201 | 1/1955 | Bannister | 294/102 A |
| 3,002,560 | 10/1961 | Paget | 214/2.5 |
| 3,561,811 | 2/1971 | Turner | 214/2.5 |
| 3,840,128 | 10/1974 | Swoboda | 214/2.5 |

*Primary Examiner*—Philip Goodman

[57] ABSTRACT

Disclosed is a pipe handling device, power-driven in three degrees of freedom, for manipulating pipe that is essentially vertically oriented. Specific embodiments described relate to racking and unracking drill pipe in a drilling derrick. A maneuverable arm, mounted on the derrick at an appropriate height, grips the pipe, lifts it and moves it to another location. A cable-assisted embodiment designed to handle heavy drill collars features a shock absorber assembly.

24 Claims, 39 Drawing Figures

529
527
521a
528
522
6'
525
523
541d
541a
537
538
531
521
524
520a
548
520
532
D
536
534
533
535

529
527
528
522
6'
525
523
521a
541d
541a
537
530
521
524
548
520a
520
538
D 529
527
521a
528
522
6'
P'
525
523
537
530
521
524
520a
548
541d
541a
D
538
520

PIPE RACKER

BACKGROUND OF THE INVENTION

1. Field of the Invention

The present invention pertains generally to the manipulation of drill pipe and drill collars in a welldrilling derrick. More specifically, the invention pertains to a derrick mounted, maneuverable racker arm for picking up and relocating essentially vertically oriented drill pipe and drill collars.

2. Description of the Prior Art

In the drilling of oil and gas wells, the drill string is made up of pipe segments commonly stored upright within the derrick. These pipe segments, usually assembled in groups of three to form a "stand," are picked up by conventional hoist means mounted in the derrick and successively screwed into the string of pipe already suspended in the well bore. In withdrawing the drill string, the procedure is reversed with the stands being unscrewed from the suspended string as the string is withdrawn from the well, and returned to the vertical storage position. Conventionally, these operations require considerable manual labor and expenditure of time, particularly in making a so-called "round trip"in which the entire drill string is withdrawn from the well to change a bit, or for other purposes, and then returned to the bottom of the well.

Electrically or hydraulically powered pipe handling systems have been developed to transport pipe members between a storage area within the derrick and the well drilling location. The objects of such systems are to reduce the manual labor required in such operations and to speed up the entire pipe handling process. These systems generally feature one or more movable arm mechanisms equipped with some means of engaging the pipe while maintaining the pipe in an essentially vertical orientation. Once engaged, the pipe may be taken from a storage area and held over the well position. At that point, a conventional pipe supporting mechanism is attached, such as an elevator, the pipe is connected to the string suspended in the well, and the arm mechanism is disengaged and withdrawn. The steps are reversed when pipe is to be withdrawn from the well, disconnected from the string, and placed in the storage area.

Whenever pipe is thus maneuvered within a derrick, it must be lifted and supported off of the derrick floor to clear the wellhead structure, etc., and to be set down on a setback structure - the platform on which the vertical standing pipes are stored. This vertical movement is usually supplied by a cable attached to the pipe-engaging means and passing over a sheave, mounted in the derrick, down to a power unit. Provision is made for the pipe engaging means to be movable vertically with respect to the arm, and the power unit operates to raise or lower the pipe engaging means as needed. If the pipe engaging means for lift is in the form of an elevator, suspended by the cable free of the arm, such as elevator must be manually placed on the pipe.

In some cases, the pipe is engaged for lifting purposes by a two-prong device which fits under the threaded box end of the pipe. Then, the maneuvering of the arm cable mechanism to pick up pipe can be a delicate operation.

SUMMARY OF THE INVENTION

A generally tubular housing, with an arm telescoped therein, is mounted on a derrick so that the arm may be extended toward the center area of the derrick. A pipe gripping means is mounted on the end of the arm extending inside the derrick. The mounting of the housing is such that the housing may be pivoted or translated vertically and horizontally, transverse to the telescoping action of the arm. These vertical and horizontal movements, combined with the telescoping of the arm in the housing, provide the pipe gripping device with three orthogonal degrees of freedom without the need of a cable support.

The pipe gripping device is a fluid-pressure activated slip assembly, capable of gripping a pipe member anywhere along its length, not just at the box end.

Different embodiments are shown for achieving the motion and powering of the housing, arm and slip assemblies.

A cable-lift system for handling heavier drill collars is shown equipped with a shock absorber assembly.

DESCRIPTION OF THE ILLUSTRATED EMBODIMENTS

FIGS. 1 to 4 illustrate the positioning and operation of a derrick-mounted pipe racker, for example, in the process of storing drill pipe segments withdrawn from a well. The pipe racker is shown schematically at 10, mounted on the derrick D. A cable C supports a traveling block and hook T, from which is suspended a rotary drive assembly, shown generally at 11. The rotary drive assembly 11 includes a rotary power assembly PA, a drive head H, and a breakout elevator E which is suspended from the drive head by a powered bails assembly, shown generally at 12. Details in the construction and operation of rotary drive assemblies are disclosed in U.S. Pat. Nos. 3,467,202; 3,774,697; 3,766,991; and 3,776,320, as well as in U.S. Pat. application Ser. No. 418,065, filed Nov. 21, 1973 and U.S. Pat. application Ser. No. 477,028 filed June 6,1974.

Figure 2:
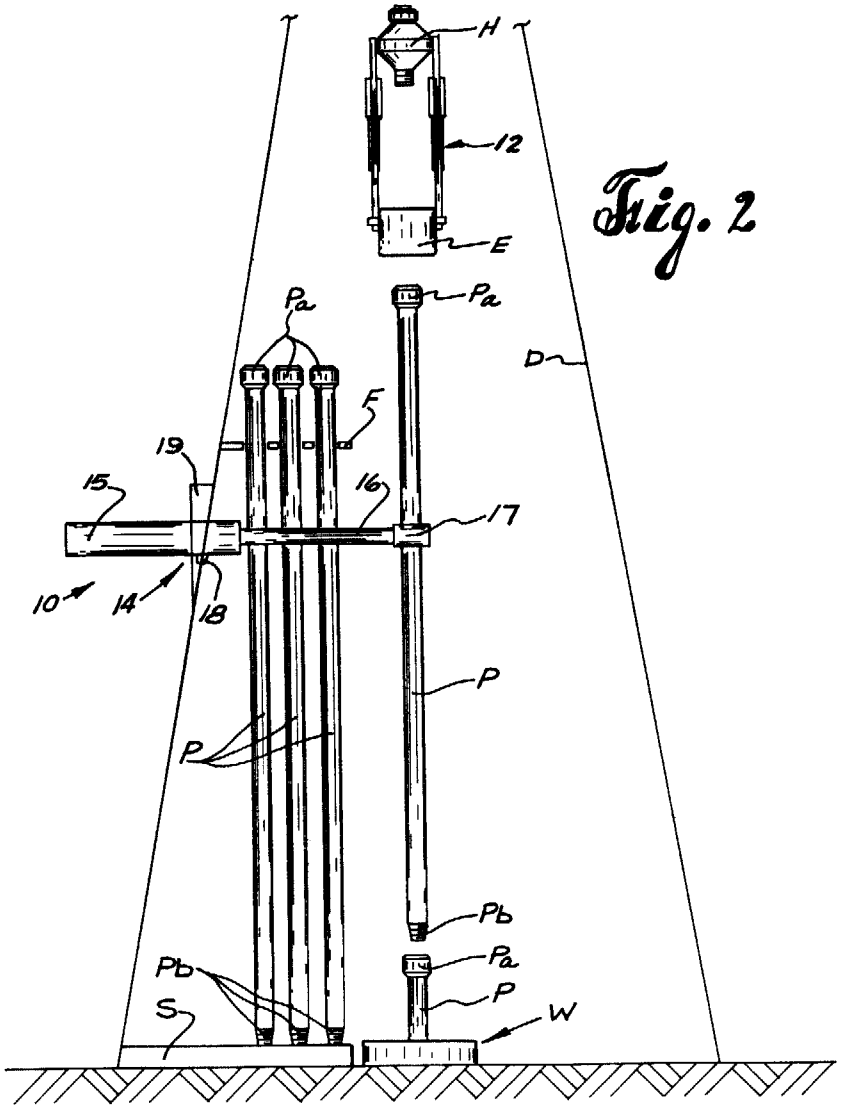
FIG. 2 is a schematic elevation similar to FIG. 1, showing pipe members, held in place on the setback structure by a fingerboard, and the pipe racker supporting a pipe member.
Figure 1:
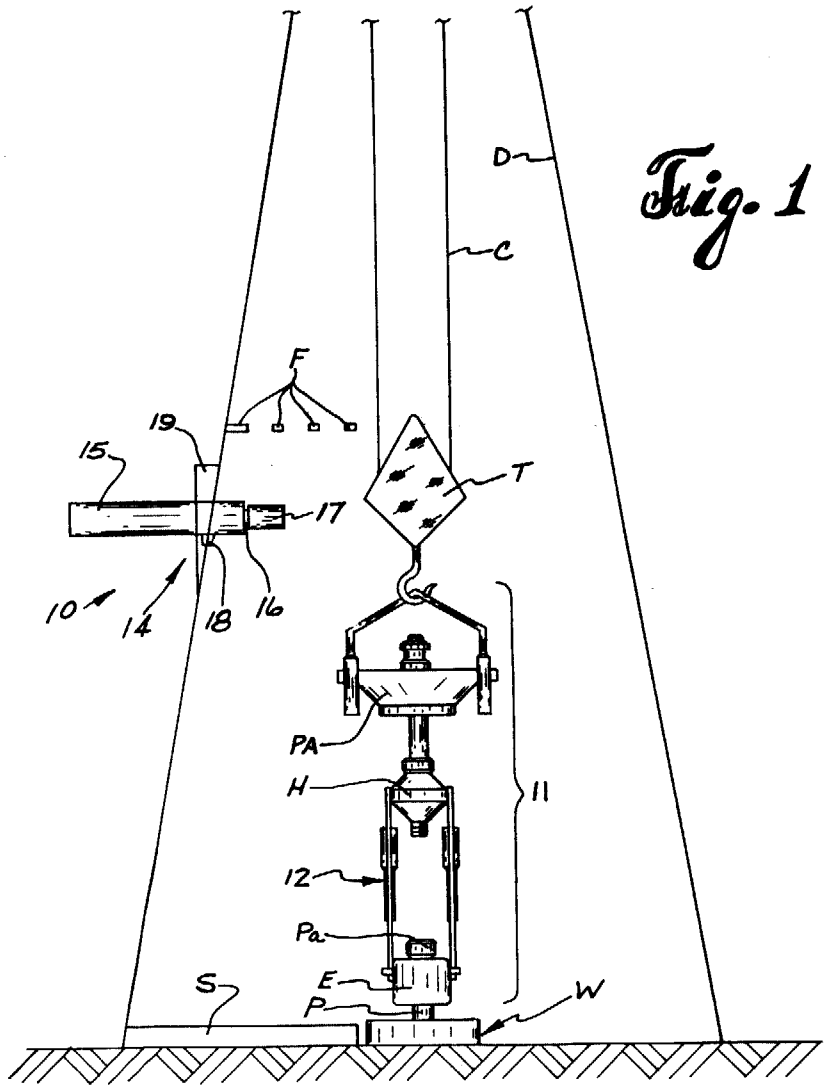
FIG. 1 is a schematic elevation of a derrick-mounted pipe racker and a rotary drive assembly suspended by a cable within the derrick.

A pipe member P is shown, in FIG. 1, being withdrawn from the wellhead at W by the elevator E. Each of the pipe members P have a female-threaded box Pa at their upper end as shown, and a male-threaded pin Pb at their lower end.

In the storage position, the pipe members P rest on setback structures S, and are maintained in their essentially vertical orientation by fingerboards F. Each fingerboard F includes a plurality of parallel, horizontal "fingers"which define slots into which the pipe members are placed. The result is that the pipe members may be stored in orderly rows, supported by the "fingers." These fingers are seen in end view in FIGS. 1 and 2.

In the schematic representations in FIGS. 1 to 4, the pipe racker 10 is shown to consist of a mounting shown generally at 14, a housing 15, an arm 16, and pipe grippeer 17. The mounting at 14 includes a horizontal track system 18 and a vertical track system 19 for horizontal and vertical movement respectively of the housing 15, arm 16 and pipe gripper 17.

Figure 4:
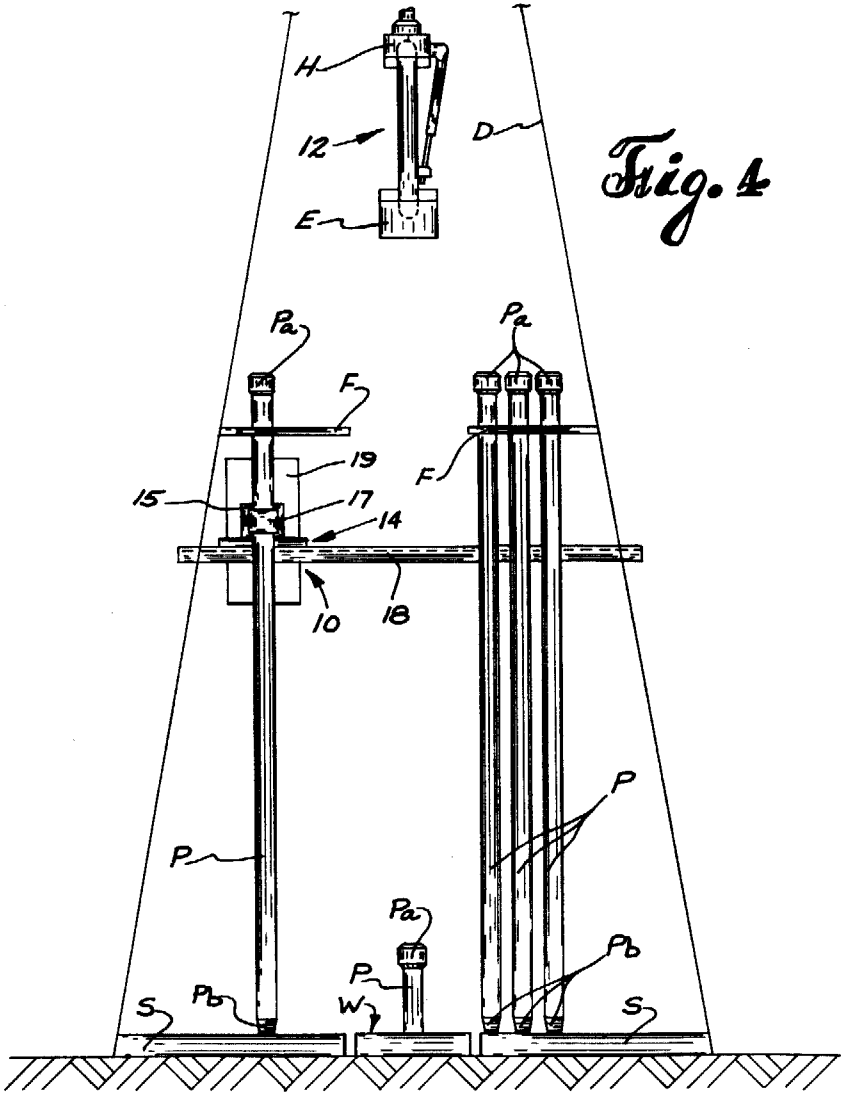
FIG. 4 is a schematic elevation similar to FIG. 3, further illustrating the horizontal maneuverability of the pipe racker, placing a pipe member in a fingerboard on the other side of the derrick from the first fingerboard.
Figure 3:
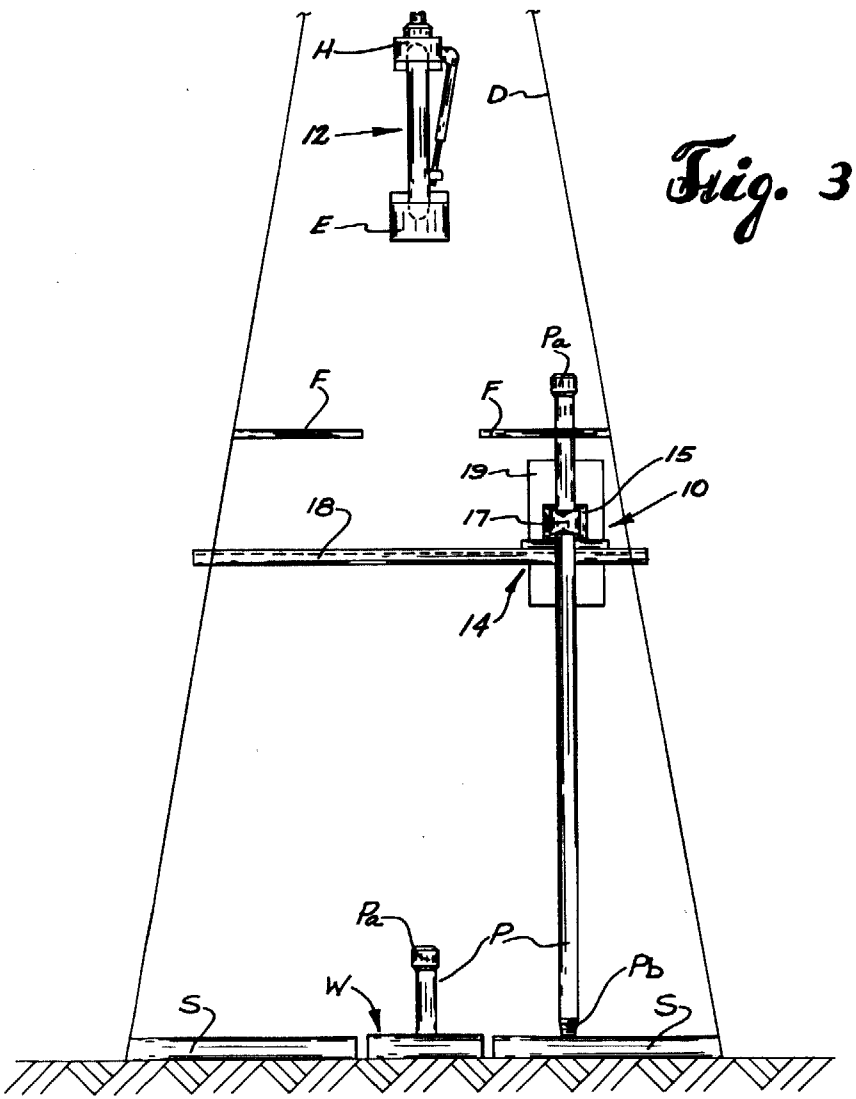
FIG. 3 is a schematic side elevation of the structure in FIGS. 1 and 2, illustrating how the pipe racker moves a pipe member into a fingerboard.

In the operation of withdrawing pipe members from a well and storing them as shown, the pipe string is raised in the well by the rotary power assembly PA. The pipe member P extending completely above the wellhead at W is disconnected, by the break-out elevator E, from the rest of the pipe string suspended below. The racker arm 16 is extended out of the housing 15 until the pipe gripper 17 is positioned to engage the disconnected pipe member P. The gripper 17 is activated to lock onto the pipe P, the housing 15 is raised on the vertical track system 19, thereby lifting the pipe member, and the pipe is released by the elevator which is then lifted out of the way. The arm 16 is retracted into the housing by an amount sufficient to align the pipe with an appropriate slot in a fingerboard F, and the housing 15 is then moved along the horizontal track 18 until the pipe is in place in the fingerboard (FIG. 3). The pipe member P is then lowered onto the setback structure S by the housing moving down the vertical track system 19, the pipe gripper 17 is disengaged and moved away from the pipe P, and the process is repeated as more pipe members are "stacked"in the fingerboards F (FIG. 4). It will be appreciated that the reverse of these steps is followed to take pipe from the fingerboards to the elevator E for making up the pipe string in the well. Although only single pipe sections are shown being manipulated in FIGS. 1 to 4, the derrickmounted pipe racker is fully capable of handling two- and three-pipe stands.

In the descriptions of different specific embodiments which follow, like components are similarly numbered.

Figure 5:
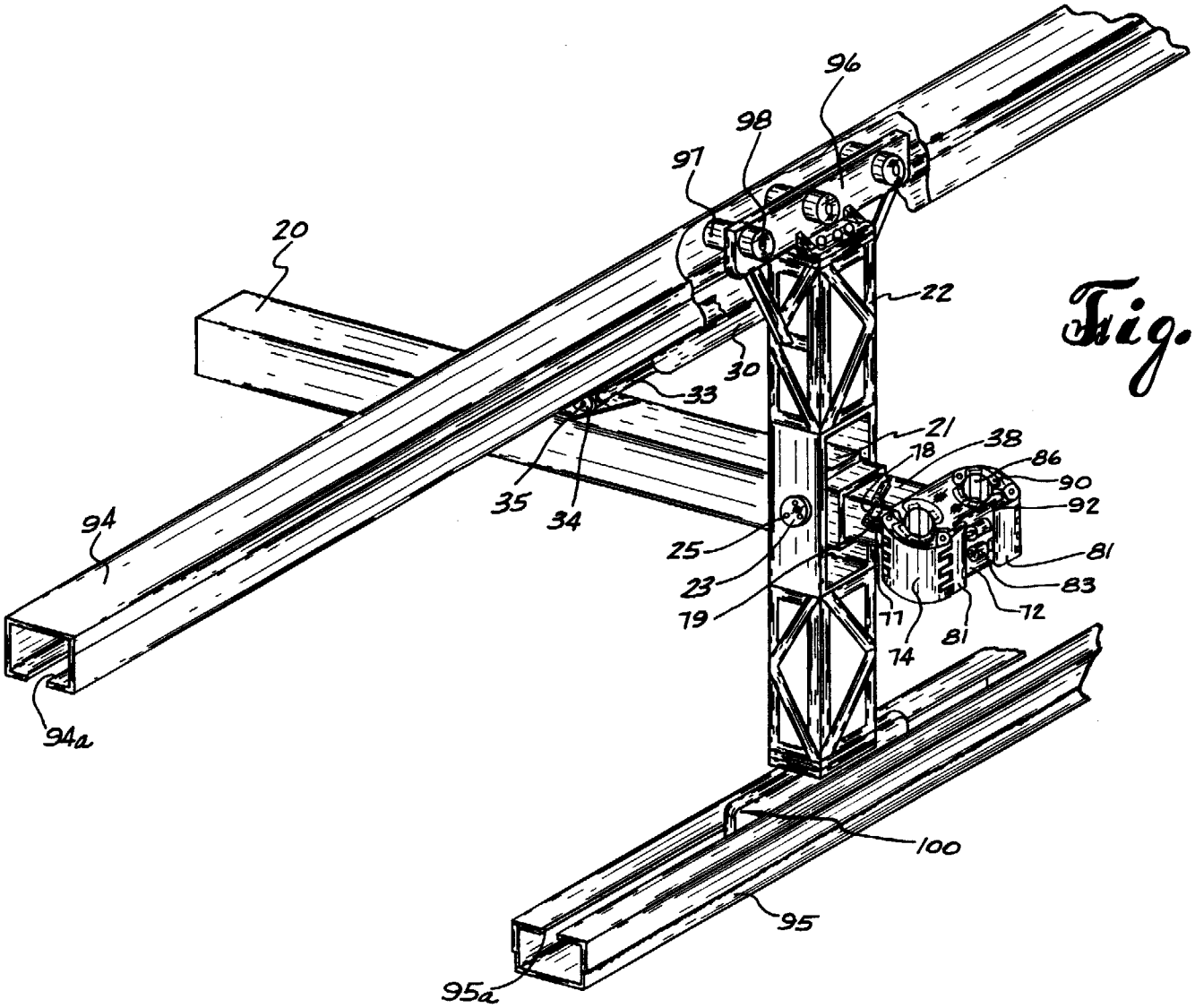
FIG. 5 is a perspective view, partially broken away, of an embodiment of a pipe racker, featuring a tilting, telescoping arm with horizontal maneuverability along tracks, and a two-sided pipe gripper.
Figure 6:
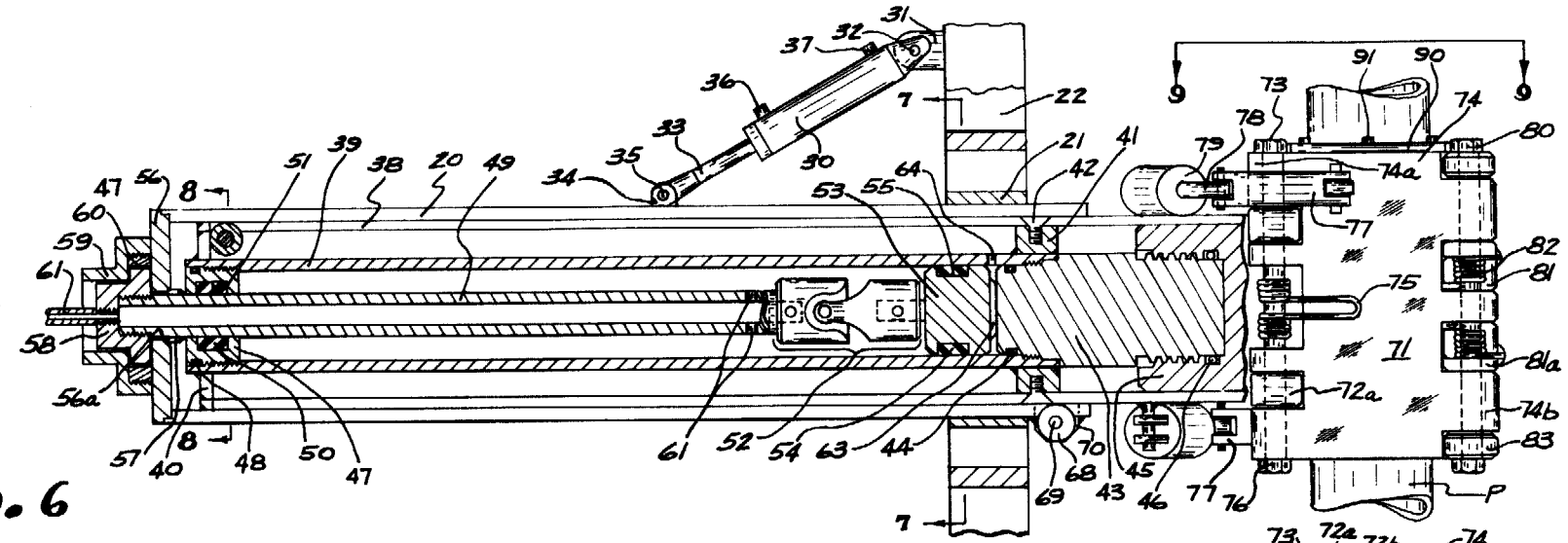
FIG. 6 is an elevation, in partial section, of the racker arm of FIG. 5, with details of the tilt and telescoping mechanisms.
Figure 7:
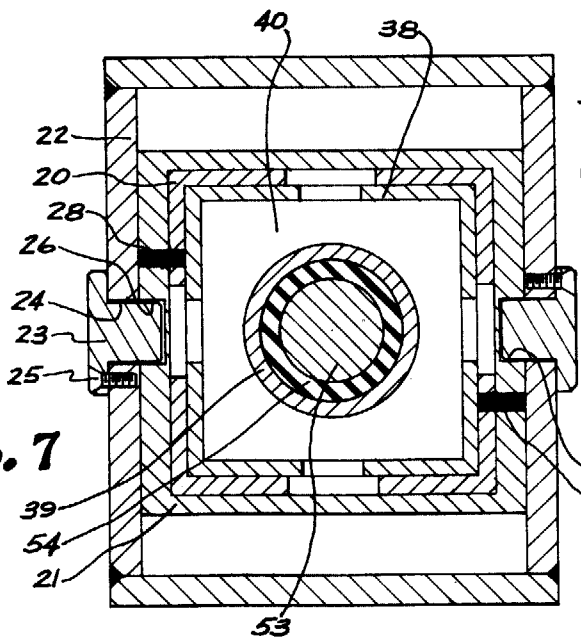
FIG. 7 is a cross-section taken along line 7—7 of FIG. 6.
Figure 8:
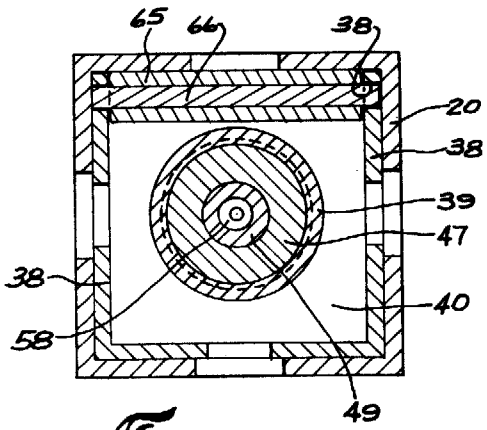
FIG. 8 is a cross-section taken along line 8—8 of FIG. 6.

A particular embodiment of the pipe racker is shown in FIGS. 5 to 12. A housing 20 is mounted in a collar 21, which is held within a vertical tower 22 by two pivot pins 23 (FIGS. 5 to 7). The pivot pins 23 are located in two through bores 24, in the vertical tower 22, and are rotatably fixed thereto by bolts 25. Recesses 26 and 27 in opposite horizontal faces of the collar 21 receive the pivot pins 23 so as to permit rotational motion of the collar and housing 20 about the coincidental axes of cylindrical symmetry of the pivot pins. Locking pins 28 in appropriate holes in the collar 21 and the housing 20 lock these two components together.

A fluid pressure cylinder 30 is pivotally held by a clevis 31 and pin 32 on the vertical tower 22; a piston arm 33 is similarly held by a clevis 34 and pin 35 on the housing 20. Fluid pressure connectors 36 and 37 on the cylinder 30 are located to be always on opposite sides of the piston head (not shown) so that fluid pressure may be thereby applied to drive and hold the piston from either side. When fluid pressure is introduced through the lower connector 36, the piston arm 33 is pulled into the cylinder 30, causing the housing 20 to pivot clockwise about the pins 23, as seen in FIG. 6; when fluid pressure is introduced through the upper connector 37, the housing rotation is counterclockwise. In this way, the housing is rotated in a vertical plane.

An arm 38 is slidably telescoped in the housing 20. Positioned concentrically within the arm 38 is a circular cylinder 39 fixed to the arm by a base plate 40 and a centering collar 41, which is held fixed to the arm by bolts 42. The cylinder 39 is closed at the right end (FIG. 6) by a cap 43, threadedly joined to the cylinder and sealed thereto by an O-ring seal 44. The other end of the cap 43 threadedly anchors a shaft 45 attached to, and thereby supporting, a pipe gripping device to be described hereinafter. An O-ring bearing 46 completes the connection between the cap 43 and the shaft 45.

The opposite, or left, end of the cylinder 39, FIG. 6, is closed by an end plug 47, threadedly connected within the cylinder, and sealed thereto by an O-ring seal 48. A hollow shaft 49 passes through the center of the end plug 47, and is slidingly sealed thereto by a packing seal 50, set in an inner annular groove 51 in the end plug. The right end of the shaft 49 (FIG. 6) is connected, through a universal joint shown at 52, to a piston head 53, slidably sealed to the cylinder 39 by a packing seal 44 set in an outer annular groove 55 in the piston head.

The left end of the shaft 49 (FIG. 6) passes through a central hole 56*a* in an end plate 56 of the housing 20. A locking ring 57 welded to the shaft 49 prevents leftward movement of the shaft through the end plate 56, and a cap 58, threadedly connected to the shaft on the outside of the housing 20, prevents rightward movement of the shaft through the end plate. The cap 58 itself is held to the end plate 56 by a partial cover 59, threadedly engaged to a ring 60, welded to the end plate.

The cap 58 contains a fluid pressure connector 61 which allows the introduction of fluid pressure into the shaft 49. Ports 62 at the far end of the shaft 49 communicate this fluid pressure to the general interior of the cylinder 39 between the piston head 53 and the end plug 47. The volume within the cylinder 39 between the end plug 47 and the piston head 53 expands in response to the fluid pressure, with the result that the cylinder, and the attached arm 38, move to the left (FIG. 6), i.e., the arm retracts into the housing 20. A pad 63, mounted on the face of the piston head 53, cushions the impact of the cap 43 in moving against the piston head. The wall of the cylinder 39 contains a fluid pressure connector 64 located between the piston head 53 and the cap 43 at the cap's position of closest approach to the piston head. The fluid pressure connector 64 allows the introduction of fluid pressure into the cylinder 39 between the piston head 53 and the cap 43, causing this volume to expand, driving the cylinder and the attached arm 38 to the right, i.e., the arm extends outwardly from the housing 20.

Since the arm 38, via the pipe gripping device supported by the shaft 45, is used to support pipe members, it will be appreciated that the farther the arm is extended out of the housing 20 the greater is the moment arm of the weight of the extended arm, pipe gripping device, and pipe member so supported about any point on the housing itself. Roller assemblies provide the contact between the arm 38 and the housing 20 at the two locations of greatest pressure therebetween; the top left edge of the arm and lower right edge of the housing as seen in FIG. 6. A roller 65, mounted on an axle 66, held in appropriate holes 67 in the side walls of the arm 38, provides rolling contact between the top of the arm and the housing 20. A similar roller 68, mounted on an axle 69 held by appropriate brackets 70 on the housing 20, provides rolling contact between the bottom of the arm 38 and the housing. The universal joint at 52 prevents any undue stressing of the shaft 49. From FIGS. 7 and 8, it will be appreciated that both the housing 20 and the arm 38 are constructed primarily of angle beams.

The particular embodiment of the pipe gripping device 71 shown in FIGS. 5, 6, 9 and 10 is capable of engaging a pipe from either side, in either of two gripping assemblies. The pipe gripping device 71 includes a body 72, fixed to the shaft 45, and equipped with two sets of lugs 72*a* receiving bolts 73 serving as hinge pins. A gate 74 is pivoted on each hinge pin 73 by appropriate lugs 74*a*. Each gate 74 is urged to a closed position over a corresponding recess 72*b* in the body 72 by a spring 75 mounted on the corresponding hinge pin 73. Nuts 76 complete the hinge couplings.

Each gate 74 is fitted with a bracket 77, pivotally connected to the piston rod 78 of a fluid pressure cylinder 79 which is pivotally mounted on the arm 38. One of the two fluid pressure cylinders 79 is mounted above the arm 38, and the other cylinder is mounted below the arm. Application of fluid pressure to a cylinder 79 swings the corresponding gate 74 open; release of fluid pressure in that cylinder 79 allows the spring 75 to close the gate.

The side of each gate 74 away from the hinge pin 73 is fitted with lugs 74*b* which receive bolts 80 serving as hinge pins. A latch 81 is pivotally held on each hinge pin 80 by lugs 81*a*, and urged toward the body 72 by springs 82. Nuts 83 on the hinge pins 80 complete the hinge couplings.

Figure 9:
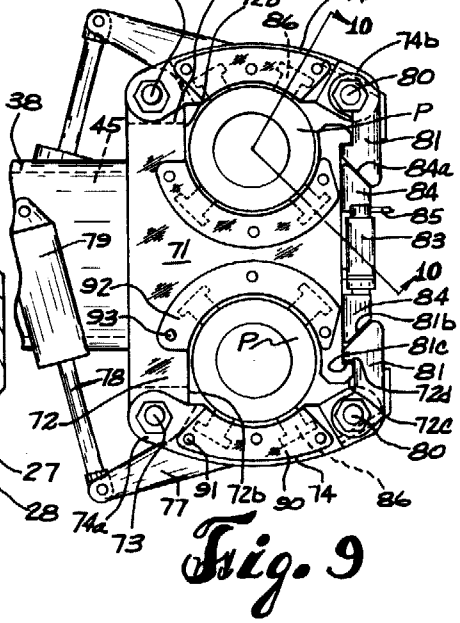
FIG. 9 is a plan view of the pipe gripping device, indicating how a pipe member may be engaged from either side.

Each latch 81 has a beveled leading edge 81*b* and a flat trailing edge 81*c* as best seen in FIG. 9. The body 72 has beveled outer edges 72*c* and flat shoulders 72*d*. As a gate 74 is being closed by its spring 75, and the corresponding springs 82 are urging the latch 81 toward the body 72 also, the beveled latch edge 81*b* rides over the beveled body edge 72*c*, against the force of the springs 82. As the latch 81 clears the body edge 72*c*, the springs 82 snap the latch forward so that the latch edge 81*c* faces the body shoulder 72*d*. The springs 82 keep the latch 81 in this "locked" position against the body 72, and the shoulder 72*d* then prevents the latch from sliding back along the body, thereby locking the gate 74 over the recess 72*b*. The latches 81 are released by fluid pressure cylinders 83 located on the front of the body 72 as best seen in FIGS. 5 and 9. The piston rod extending from each cylinder 83 ends in a shoe 84 with a flat side that slides along the body, and a beveled edge 84a. Within the cylinder 83, the piston head is biased away from the corresponding latch 81 by a spring (not shown); when fluid pressure is introduced through a fluid pressure connector 85, the piston head and piston rod are driven toward the latch, the beveled shoe surface 84*a* forces the beveled latch surface 81*b* away from the body 72 until the flat latch surface 81*c* clears the body shoulder 72*d*, and the latch is unlocked. The gate 74 is then able to be withdrawn from the recess 72*b* by operation of the fluid pressure cylinder 79.

Figure 10:
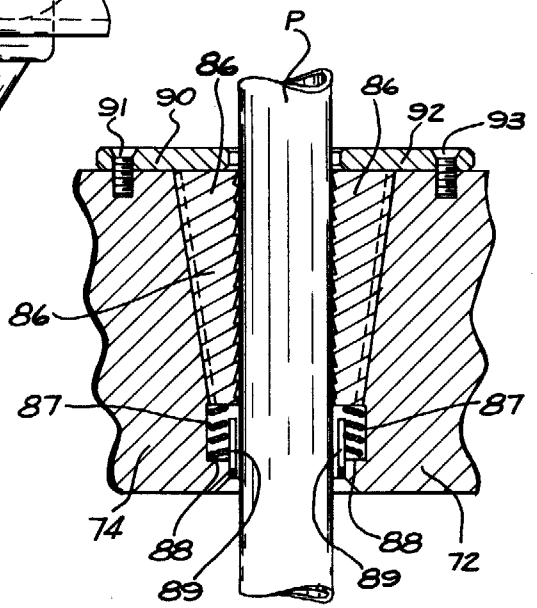
FIG. 10 is a view, in partial section, taken along line 10 —10 of FIG. 9.

The two recesses 72*b* are pipe-receiving areas. As seen in FIG. 9, each recess 72*b* is partially circular, with a radius of curvature large enough to accommodate the body of a pipe member P, but smaller than the radius of the box Pa. The surface of each gate 74 that faces the recess 72*b* when the gate is closed is also partially circular. This inner gate surface and the corresponding recess 72*b* each hold, in slanted dove-tail unions, a pair of slip dies 86. As best seen in FIG. 10, each slip die 86 has a concave, curved inner face lined with horizontal edges and grooves capable of gripping a pipe member P and providing vertical support to it. Below each slip die 86 is a load compensating spring 87 resting on a shoulder 88, and kept in place by a keeper plate 89 welded to the shoulder. A restraining plate 90 held on the gate 74 by bolts 91, and another such plate 92 held on the body 72 by bolts 93, limit the upward movement of the slip dies 86.

When a pipe member P is placed within a recess 72*b*, the gate 74 closed and the latch 81 locked, the four slip dies 86 contact the pipe member. Raising the arm 38 by operation of the fluid pressure cylinder 30 causes the body 72 and gate 74 to rise with respect to the pipe member P. The drag exerted by the pipe member P on the slip dies 86 by virtue of the contact between the pipe surface and the horizontal edges on the slip dies causes the slip dies to be urged downward in their respective dove-tail unions. This downward motion of the slip dies 86 compresses the springs 87 and, because of the slant of the dove-tail unions, forces the slip dies against the pipe member P. The wedging effect on the slip dies 86 results in an increasingly tighter gripping of the pipe member P by the slip dies, allowing the pipe racker to thereby lift the pipe by gripping it at any point along its length. When the pipe P is set down by the pipe racker, the restraining plates 90 and 92 prevent the slip dies 86 from moving upward out of the dove-tail unions as the weight of the pipe is withdrawn from the slip dies.

Figure 11:
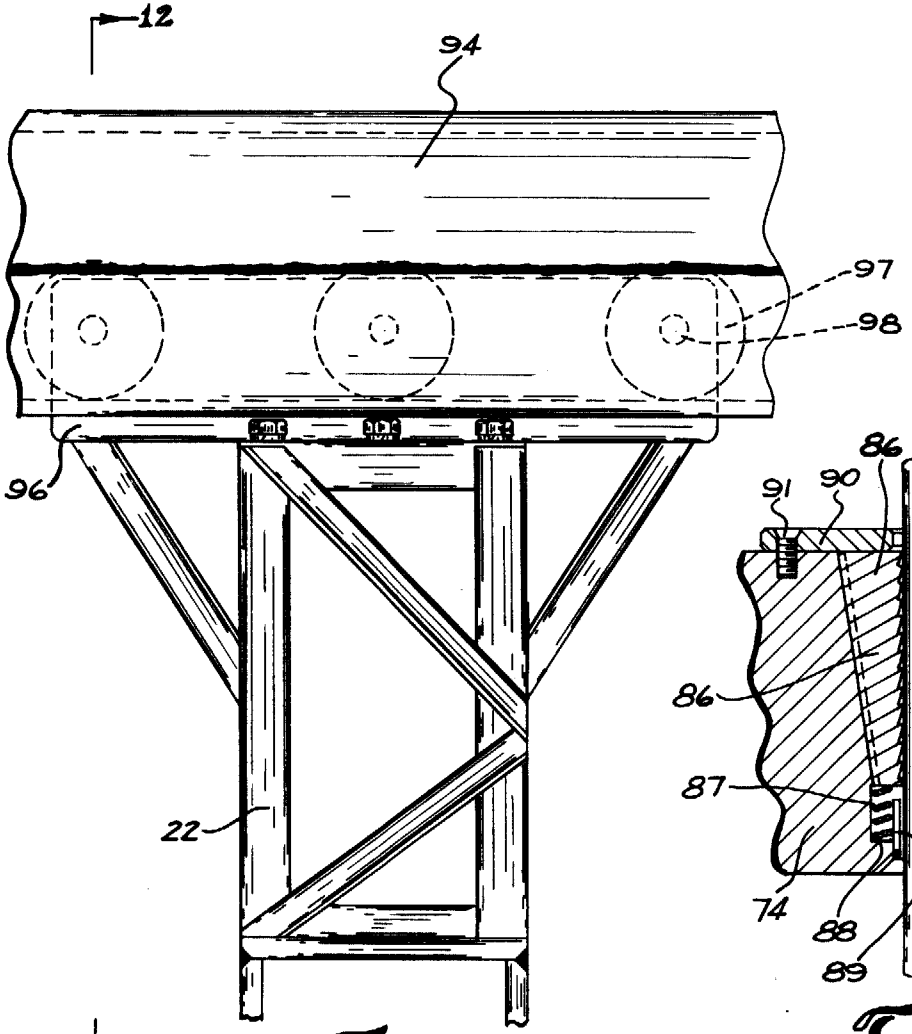
FIG. 11 is a partial elevation of the upper suspension and trolley arrangement of the pipe racker.
Figure 12:
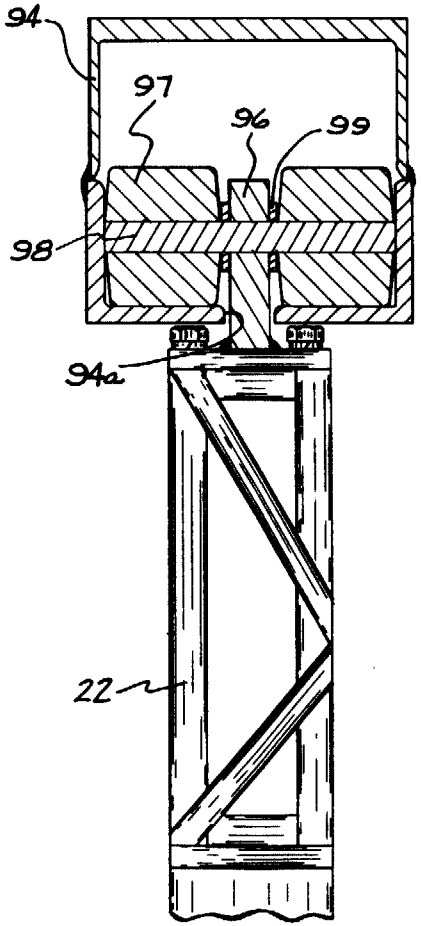
FIG. 12 is a cross-section taken along line 12—12 of FIG. 11.

The pipe racker embodiment illustrated in FIGS. 5 to 12 is supported on a derrick by horizontal track systems 94 and 95, each of which is mounted on the derrick in the manner of the horizontal track system discussed in relation to FIGS. 1 to 4. The track systems 94 and 95 are each constructed of a channel beam and two angle beams welded as indicated in FIGS. 5, 11 and 12 to provide a box-like structure with a slot running the length of the box. The slot 94*a* in the upper track system 94 is on the bottom; the slot 95*a* in the lower track system 95 is on the top. A trolley 96 with three pairs of wheels 97 mounted on axles 98 with bearings 99 is attached by appropriate means to the top of the vertical tower 22 so as to extend upwardly through the slot 94*a*. In this position, the wheels 97 ride on the bottom inside of the track system 94 and, through the trolley 96, support the pipe racker while permitting horizontal movement of the pipe racker along the track system 94. A similar trolley and wheel assembly, shown generally at 100, is attached to the bottom of the vertical tower 22, and extends through slot 95*a* in the lower track system 95. The wheels of the trolley assembly 100 ride on the inside bottom of the lower track system 95. In this way, the pipe racker is supported by the trolleys at the top and at the bottom of the vertical tower 22 and is permitted horizontal movement along the track systems 94 and 95, perpendicular to the direction of telescoping movement by the arm 38. A power source (not shown) may be attached at either trolley to drive the wheels to selectively propel the pipe racker along the track systems 94 and 95.

In summary, it will be appreciated that the pipe gripping device 71 is selectively movable, via power sources, in three orthogonal directions: toward and away from the center area of the derrick by the telescoping of the arm 38; parallel to a derrick side, along the track systems 94 and 95; and substantially vertically, by pivoting about the pins 23, through operation of the fluid pressure cylinder 30.

FIGS. 13 to 16 reveal a variation on the telescoping action of the racker arm, as well as a different embodiment for the pipe gripping device. As in the pipe racker embodiment shown in FIGS. 5 to 12, a housing 120 is mounted in a collar 121 which is held in a vertical tower 122 by two pivot pins 123. The pivot pins 123 are located in two through bores 124 in the vertical tower 122, and are rotatably fixed thereto by bolts 125. Recesses 126 and 127 in opposite faces of the collar 121 receive the pivot pins 123 so as to permit rotational motion of the collar and housing 120 about the coincidental axes of cylindrical symmetry of the pivot pins. The housing 120 is welded to the collar 121 so that the housing and collar rotate as a unit.

Figure 13:
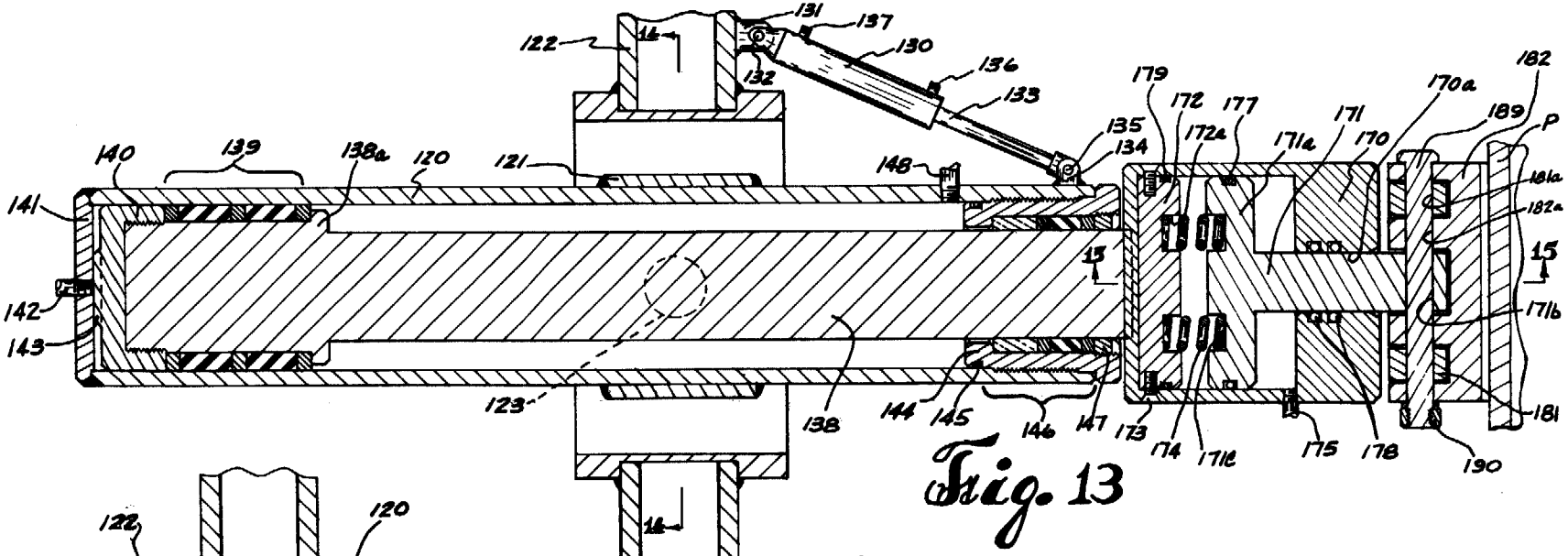
FIG. 13 is an elevation, in partial section, of another embodiment of a racker arm and pipe gripping device.

A fluid pressure cylinder 130 is pivotally held by a clevis 131 and pin 132 on the vertical tower 122; a piston arm 133 is similarly held by a clevis 134 and pin 135 on the housing 120. Unlike the embodiment shown in FIGS. 5 and 6, wherein the corresponding fluid pressure cylinder 30 was on the outward side of the vertical tower 22, i.e., opposite the pipe gripping device 71, here the fluid pressure cylinder 130 is toward the interior of the derrick, on the same side of the vertical tower 122 as the pipe gripping device described in detail hereinafter. Fluid pressure connectors 136 and 137 on the cylinder 130 are located to be always on opposite sides of the piston head (not shown) so that fluid pressure may be thereby applied to drive and hold the piston from either side. When fluid pressure is introduced through the lower connector 136, the piston arm 133 is pulled into the cylinder 130, causing the housing 120 to pivot counterclockwise about the pins 123, as is seen in FIG. 13; when fluid pressure is introduced through the upper connector 137, the housing rotation is clockwise. Thus, as in the version shown in FIGS. 5 to 12, the housing 120 of the pipe racker may be rotated in a vertical plane.

The housing 120 forms a fluid pressure cylinder, and contains, as a piston, an arm 138 slidably telescoped in the housing. Toward the left end (FIG. 13), or back, of the housing cylinder 120, the arm 138 widens to form a shoulder 138a, that is smaller in radius than is in the interior of the housing. Beyond this shoulder 138a, a series of annular rings 139, made of resilient material and locked onto the arm 138 by a cap 140, form a slidable fluid pressure seal between the arm and the inner surface of the housing 120. An end plate 141, with a fluid pressure connector 142, closes the housing 120 at that end. A pad 143, carried by the cap 140, limits the movement of the arm toward the end plate 141.

At the opposite end of the housing cylinder 120, an annular sleeve 144 is threadedly connected to the housing. The sleeve 144 extends inside the housing 120, and is sealed to the housing against fluid pressure by an O-ring seal 145. The sleeve 144 in turn is slidably sealed to the arm 138 by a series of annular rings 146, made of resilient material and locked within the sleeve by a retaining ring 147. A fluid pressure connector 148 penetrates the housing 120 close enough to the sleeve 144 so as to be always between the sleeve and the seal rings 139 beyond the shoulder 138*a* as the arm 138 telescopes into and out of the housing.

The arm 138 acts as a piston within a fluid pressure cylinder in the form of the housing 120. Fluid pressure introduced into the housing 120 through connector 142 expands the volume within the housing between the end plate 141 and the cap 140 by driving the arm 138 out of the housing and toward the interior of the derrick. Introduction of fluid pressure through the connector 148 expands the volume of the annular region within the housing 120 between the shoulder 138a and seal rings 139, and the sleeve 144 and rings 146 driving the arm 138 into the housing, and away from the interior of the derrick. In this way, the telescoping motion of the arm 138 is powered by fluid pressure.

Figure 15:
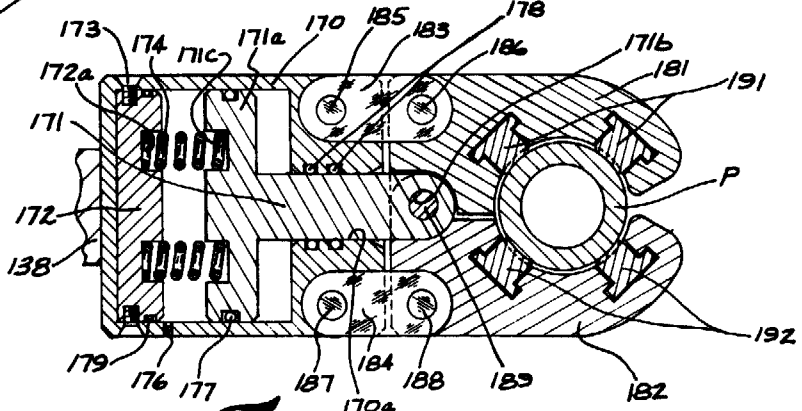
FIG. 15 is a partial cross-section taken along line 15—15 of FIG. 13.
Figure 14:
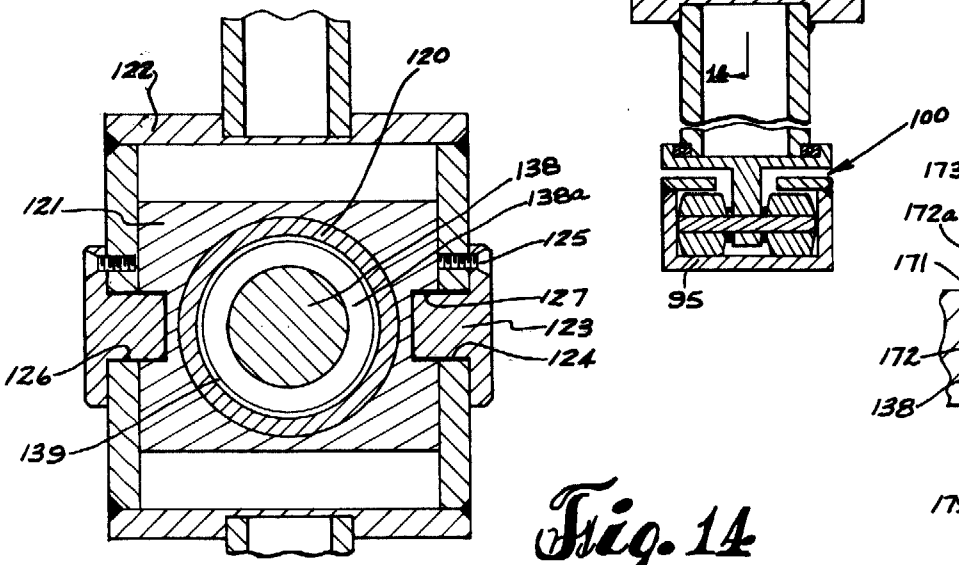
FIG. 14 is a cross-section taken along line 14—14 of FIG. 13.
Figure 19:
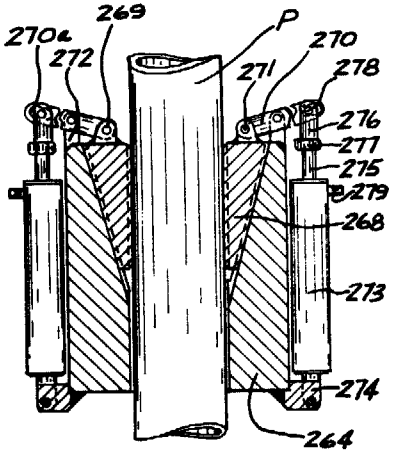
FIG. 19 is a partial cross-section taken along line 19—19 of FIG. 18.
Figure 16:
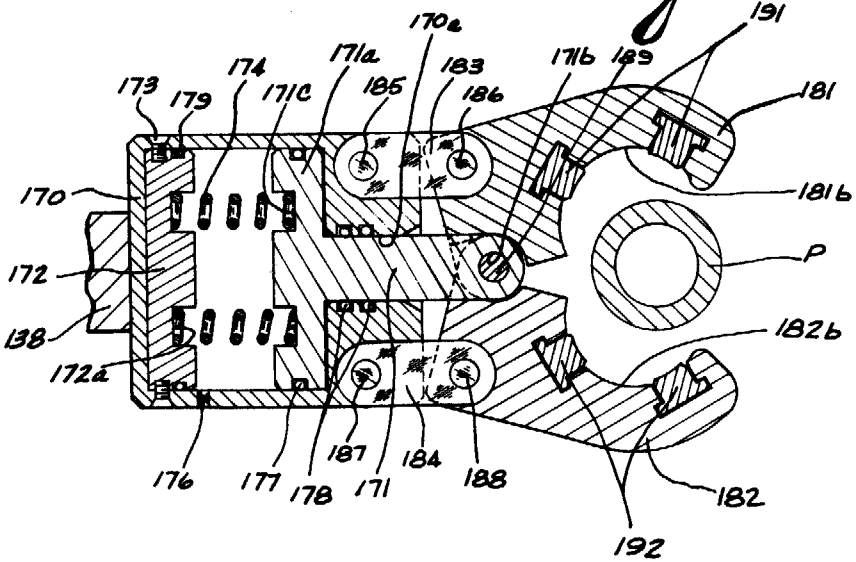
FIG. 16 is a partial cross-section similar to FIG. 15, showing the slip holders of the pipe gripping device in the "open" position.

FIGS. 13, 15 and 16 illustrate another embodiment of a pipe gripping device. A hollow casing 170 is welded to, and moves with, the arm 138. A piston 171, with a piston head 171*a*, is positioned within the casing 170 for reciprocal motion parallel to the arm 138 direction. The result is a fluid pressure cylinder and piston arrangement. The piston 171 penetrates a throughbore 170*a* in the end of the casing 170 opposite the arm 138, and ends with a lateral through-bore 171*b* (FIG. 15).

A base plate 172 is held fixed at the inner end of the casing 170 by bolts 173. Four coil springs 174 are held between the base plate 172 and the piston head 171*a*, being restrained in appropriate recesses 172*a* and 171*c* in the base plate and piston head respectively. The springs 174 urge the piston head 171*a* away from the base plate 172. A fluid pressure connector 175, located in the casing 170 so as to be always between the piston head 171*a* and the end of the casing opposite the base plate 172, allows the introduction of fluid pressure into the casing within that region to drive the piston 171 toward the base plate, compressing the springs 174. An air vent 176 in the casing 170 between the base plate 172 and the piston head 171*a* permits equilization of air pressure within that region compared to the atmosphere as the piston 171 is operated back and forth within the casing, driven by the springs 174 and by the fluid pressure introduced through the connector 175. An O-ring seal 177 provides a slidable fluid pressure seal between the piston head 171*a* and the inner wall of the casing 170, and two O-rings 178 provide such a seal for the piston 171 within the casing throughbore 170*a*. A single O-ring 179 provides a fluid pressure seal between the base plate 172 and the casing 170.

As seen in FIG. 15, a pair of slip holders 181 and 182 are joined to the casing by hinge plates 183 and 184, respectively. The one hinge plate 183 is pivotally fixed to the casing 170 by a hinge pin 185, and to the slip holder 181 by another hinge pin 186. The other hinge plate 184 is similarly fixed to the casing 170 by a hinge pin 187, and, by another hinge pin 188, to the slip holder 182. The through bore 171*b* in the piston 171 is aligned with similar through-bores in brackets extending from the two slip holders 181 and 182, 181a and 182*a* respectively. A hinge pin 189 passes through all three through-bores 171*b*, 181*a*, and 182*a*, linking the piston 171 with the two slip holders 181 and 182. A nut 190 retains the hinge pin 189 in place.

Each slip holder 181 and 182 ends in a hook-like shape, with a circular arc inner surface, 181*b* and 182*b* respectively. The two slip holders 181 and 182 together form a nearly complete circularly cylindrical cavity to accommodate a pipe member P as shown in FIG. 15. Mounted in slanted dove-tail unions, in the curved, inner face of each slip holder, 181*b* and 182*b*, is a pair of slip dies 191 and 192, respectively, identical to the slip dies 86 hereinbefore described. The mounting of the slip dies 191 and 192, with load compensating springs, keeper plates, and restraining plates (not shown), as well as their operation in gripping and supporting a pipe member P, is identical to the mounting and operation of the slip dies 86 described in relation to FIGS. 5 to 12. The operation of the slip holders 181 and 182 is, however, unique.

As the piston 171 is pushed forward by the springs 176, the hinge pin 189 is pushed by the piston 171, and in turn pushes outwardly against the slip holder brackets 181*a* and 182*a*. The restraint supplied by the hinge plates 183 and 184 causes the slip holders 181 and 182 to pivot about the hinge pins 186 and 188 respectively. The slip holders 181 and 182 thus "open" for the purpose of inserting a pipe member P into the gripping device, or releasing a pipe member (FIG. 16). The reverse operation, occurring when fluid pressure is introduced into the pipe gripping device through the connector 175, results in the fluid pressure driving the piston 171 toward the base plate 172, pulling the hinge pin 189 toward the casing 170. The slip holder brackets 181*a* and 182*b* are pulled by the hinge pin 189, and the slip holders pivot inwardly about the hinge pins 186 and 188, and "close." Then, a pipe member P positioned between the slip holders 181 and 182 is engaged by the pipe gripping device, and supportable by the slip dies 191 and 192 as described hereinbefore in relation to the pipe gripping device in FIGS. 5, 6, 9 and 10.

The telescoping action of the arm 138, acting as a piston in the fluid pressure cylinder formed by the housing 120, supplies motion to the pipe gripping device toward and away from the interior of the derrick as needed to transport pipe members between a storage area and the well head. Vertical motion is provided to the pipe gripping device by operation of the fluid pressure cylinder 130, causing the housing 120 and arm 138 to pivot, in a vertical plane, about the pivot pins 123. The same horizontal track systems as described hereinbefore, and illustrated in FIGS. 5, 11 and 12, are employed to mount the present pipe racker embodiment on a derrick, and to provide motion to the pipe gripping device along the track systems parallel to a side of the derrick. FIG. 13 shows some detail of the lower track system, and of the trolley and wheel system, identified as 95 and 100, respectively, as in FIG. 5.

Another specific embodiment of the pipe racker is shown in FIGS. 17 to 23. Again, components identical in construction and operation to components in embodiments described hereinbefore are similarly numbered. The same pivotal motion in a vertical plane, actuated by a fluid pressure cylinder, and telescoping arm motion, as described in conjunction with the embodiment shown in FIGS. 13 to 16, are employed in the present embodiment to supply vertical and horizontal motion to the pipe gripping device. Consequently, components 220 to 248 in FIGS. 17 to 23 perform exactly as do components 120 to 148 in FIGS. 13 to 16.

The racker arm 238 ends in a mounting plate 260, to which is fixed, by nuts and bolts 261, a base plate 262. The base plate 262 is welded to a base 263 in the form of a box beam, to which is attached the body 264 of the pipe gripping device.

Figure 18:
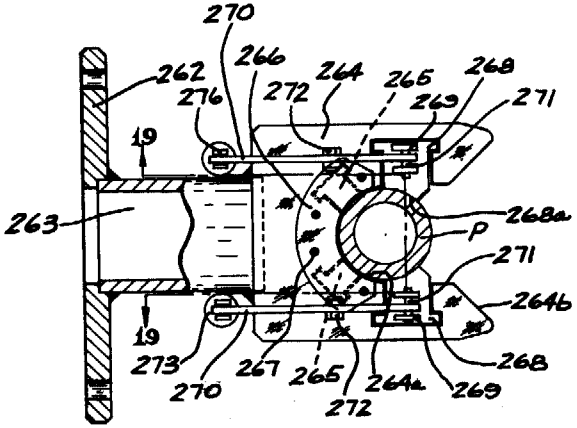
FIG. 18 is a plan view, in partial section, taken along line 18—18 of FIG. 17.

The pipe gripping device body 264 is essentially a box, with a U-shaped recess 264*a* on the end opposite the racker arm 238 (FIG. 18). The inner portion of the recess 264*a* is circularly curved to accommodate a pipe member P. The mouth 264*b* of the recess 264*a* is beveled on each side of the cylindrical recess to provide guide surfaces to facilitate the insertion of a pipe member into the recess.

The innermost portion of the recess 264*a* is fitted with two slip dies 265, held in slanted dove-tail unions with the body 264, together with load compensating springs and keeper plates (not shown). The slip dies 265 function exactly as do the slip dies 86, 191 and 192 described hereinbefore. A restraining plate 266, held to the body 264 by bolts 267, limits the upward movement of the slip dies 265.

Figures 17, 20, 21, 22, 23:
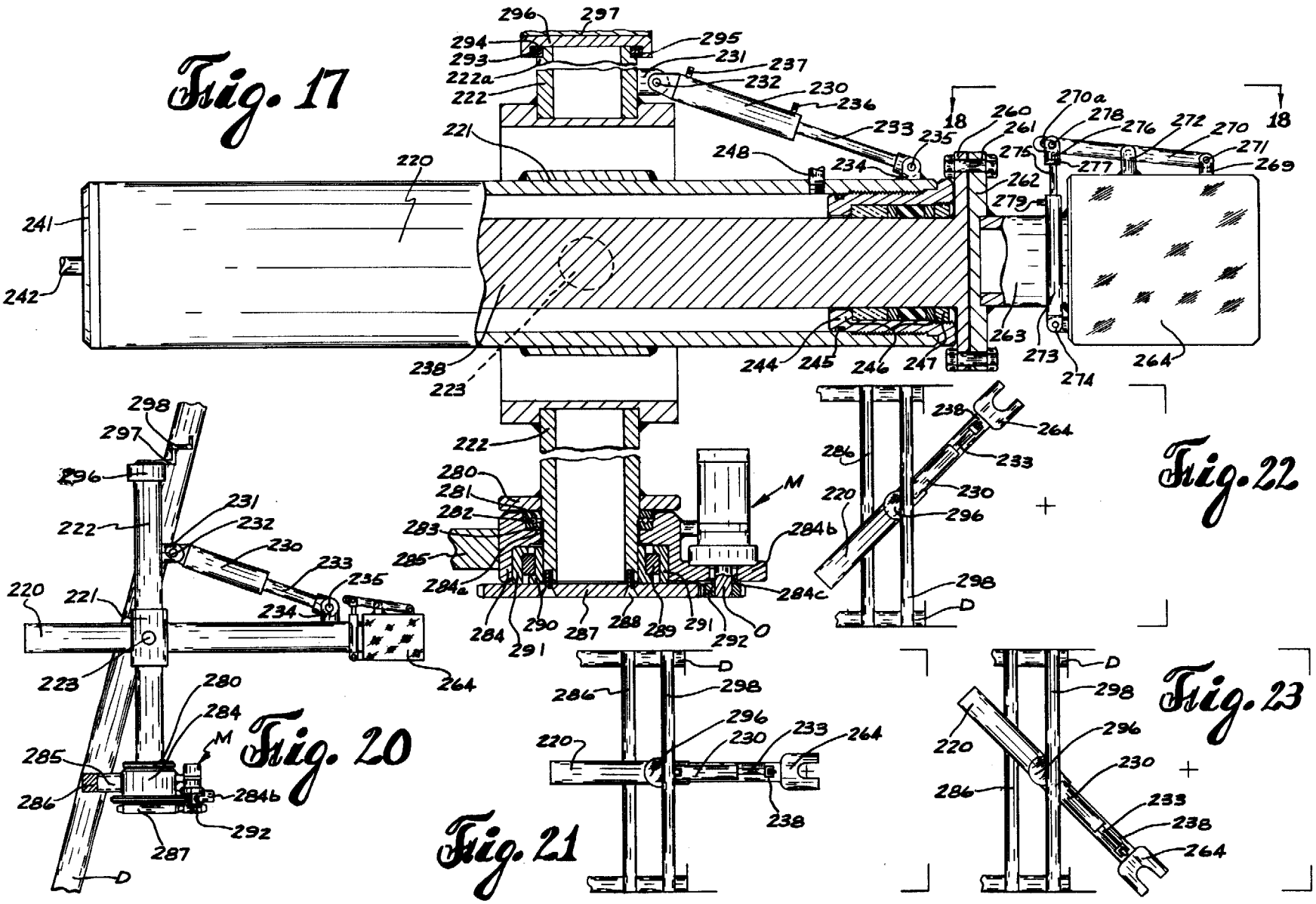
FIG. 17 is an elevation, in partial section, of the racker arm shown in FIG. 13, but with another embodiment of a pipe gripping device, and a swivel mounting for horizontal motion.
FIG. 20 is a side elevation, in partial section, illustrating the swivel mounting of the racker arm.
FIG. 21 is a schematic plan view of the pipe racker mounted on a derrick.
FIG. 22 is a schematic plan view similar to FIG. 21 showing the racker arm swiveled to one side.
FIG. 23 is a schematic plan view similar to FIGS. 21 and 22, showing the racker arm swiveled to the other side.

Along each side of the recess 264*a*, toward the mouth 264*b*, another slip die 268 is held in a slanted, dove-tail union with the body 264. Each of the two slip dies 268 differs from the previous slip dies mentioned in that the slip dies 268 are smooth-faced, i.e., they do not have horizontal edges and grooves for gripping pipe. The curved, smooth face 268*a* of each of these slip dies 268 is set at an angle to contact a pipe member P inserted within the recess 264*a*, block its exit through the mouth area 264*b*, and force it against the gripping slip dies 265, as best seen in FIG. 18. The top of each slip die 268 is fitted with a clevis 269 within which is placed the load-bearing end of a first-order lever 270, pivotally held to the clevis by a pin 271 (FIG. 17). A bracket and pin combination 270, set on the body 264, serves as the fulcrum. A fluid pressure cylinder 273 is mounted by a clevis and pin combination 274 on the back of the body 264, toward the arm 238. A piston 275 extends upwardly and ends in a link 276, adjustable for height along the piston by a nut 277. The link 276 forms a clevis in which the end of the lever 270 is held by a pin 278.

A separate fluid pressure connector 279 permits the introduction of fluid pressure into each of the cylinders 273 on the lever side of the piston head within the cylinder (not shown), to drive the piston 275 downwardly. Such downward motion of the piston 275 rotates the lever 270 about the fulcrum 272 to raise the load-bearing end of the lever at the slip die 268. As the slip die 268 rises, the slant of its dove-tail union with the body 264 causes the slip die to move into the body, outwardly from the recess 164*a*. The operation of both pistons 275 to rotate the levers 270, raising the slip dies 268 to move them outwardly from the recess 264*a*, clears the recess for insertion or release of a pipe member P through the mouth area 264*b*. Once a pipe member P is inserted in the recess 264*a*, the fluid pressure in the cylinders 271 may be reduced, and gravity will draw the slip dies 268 downward, rotating the lever arms 270 in the opposite direction. The fall of the slip dies 268 along their respective slanted dove-tail unions with the body 264 causes the slip dies 268 to move into the open area of the recess 264*a*, contacting the pipe member P, and blocking the pipe member from moving out of the recess. The slip dies 268 then cooperate with the slip dies 265 to grip and support the pipe member P. Thus, by operation of the fluid pressure cylinders 273, the dies 268 may be operated to allow the selective engaging and releasing of pipe members P by the pipe gripping device. A slot 270*a* in each lever arm 270 through which the respective pin 278 passes to form the joint with the respective link 276, and the sufficiently loose fit of each slip die 268 in its dove-tail union with the body 264, accommodate the slight lateral movement of the ends of the lever arms incident to rotation of the lever arms.

The vertical tower 222, to which the collar 221 is pivotally mounted by the pivot pins 223, is primarily a cylindrical beam mounted on the derrick so as to be rotatable about its own axis of cylindrical symmetry. Details of this mounting are shown in FIGS. 17 and 20. A collar 280 is welded to the tower 222 near its base. An upper ball-bearing raceway 281, attached to the bottom of the collar 280, rotatably rides on a plurality of ball bearings 282 (only two visible), which in turn rides on a lower raceway 283. The tower 222 extends downwardly within an essentially tubular base 284. The lower raceway 283 sits on an internal, annular shoulder 284*a* of the base 284. A beam 285 connects the base 284 to a lower cross beam 286, mounted on the derrick D and, thereby, providing vertical support to the pipe racker.

A horizontal spur gear 287 is mounted on the bottom of the tower 222 by bolts 288. Within an annular cavity formed by the tower, the spur gear, and the base, a plurality of roller bearings 289 rides between an inner raceway 290 in contact with the tower 222 and the spur gear 287, and an outer raceway 291 in contact with the base 284. A motor, shown generally at M, is mounted on a shelf 284*b* of the base 284. The output shaft O of the motor M passes downwardly through a throughbore 284*c* in the shelf 284*b*. A pinion 292 is mounted on the shaft O, and meshes with the spur gear 287. The motor M, which may be powered by either fluid pressure or electricity, is selectively operated to turn the pinion 292, which, by acting on the spur gear 287, rotates the tower 222 with respect to the derrick D. This rotational motion of the pipe racker is illustrated in FIGS. 21 to 23, wherein the pipe racker is shown in three different positions. The ball bearings 282 transmit vertical support to the rotatable tower 222, and the roller bearings 289 sustain lateral forces exerted by the tower as the pipe racker supports the weight of pipe members. The top of the tower 222 is journaled within a plurality of ball bearings 293 (only two visible), riding between an inner raceway 294, fixed on an annular shoulder 222*a* of the tower, and an outer raceway 295, lining the interior of a cup 296. The cap 296 is held by a brace 297 to an upper cross beam 298, mounted on the derrick similarly to the lower cross beam 286. In this way, the housing 220 and arm 238 are rotated in a horizontal plane about the cylindrical axis of the tower 222.

In summary, the pipe gripping device, with body 264, is rotatably movable in a horizontal plane by operation of the motor M to rotate the tower 222, elevatable by operation of the fluid pressure cylinder 230, and movable toward and away from the tower by operation of the telescoping arm 238 as a piston in the housing-cylinder 220.

The same pipe gripping device described in the embodiment shown in FIGS. 17 to 23 is used in the pipe racker embodiment illustrated in FIGS. 24 to 30 wherein the pipe gripping device is indicated generally at G. One method of powering the telescoping movement of the racker arm in the present embodiment is similar to that described hereinbefore in relation to FIGS. 5 to 9.

Figure 24:
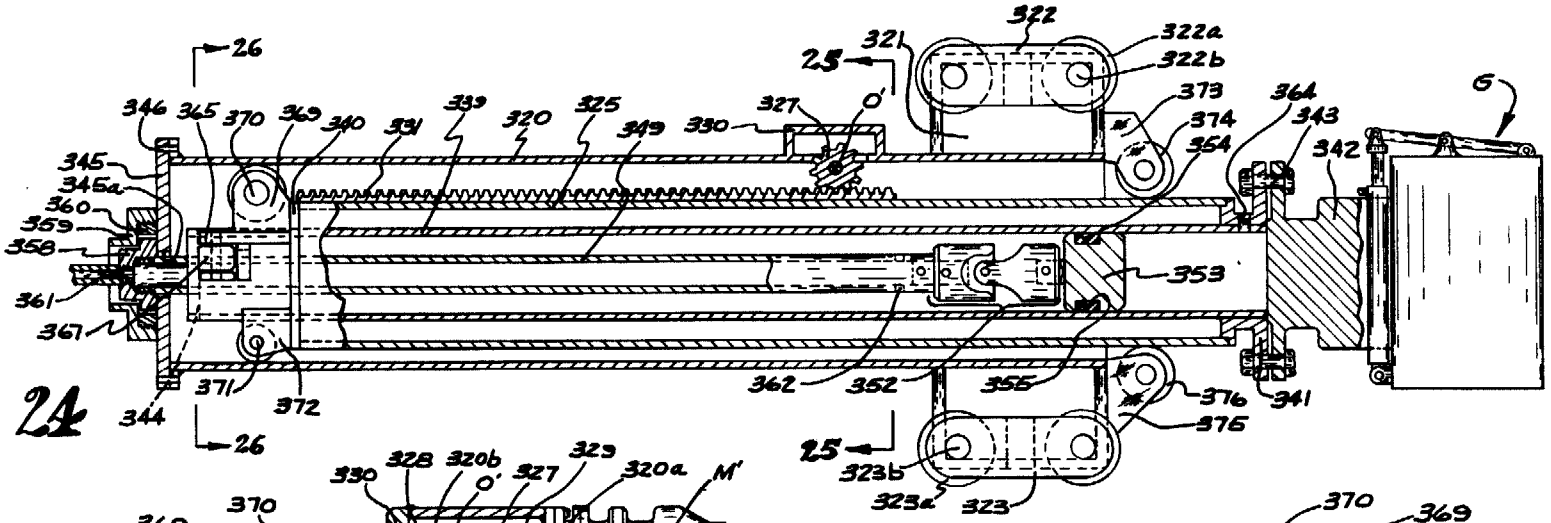
FIG. 24 is a side elevation, in partial section, of another embodiment of the racker arm.
Figure 26:
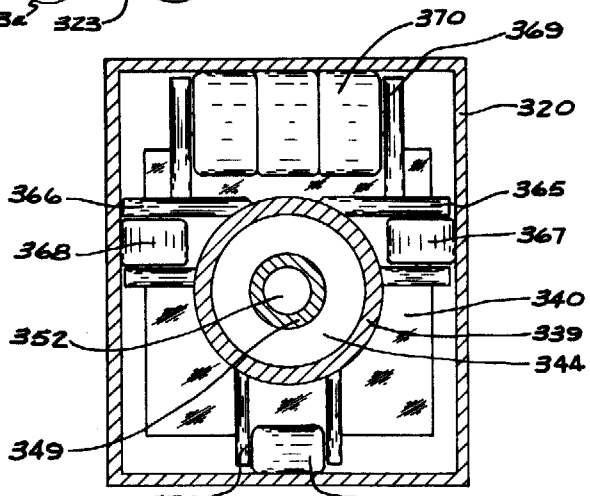
FIG. 26 is a partial cross-section taken along line 26—26 of FIG. 24.

A housing 320, maintained essentially horizontal, is fitted at its forward end, i.e., the end toward the interior of the derrick, with a vertical frame or carriage assembly 321. At the top of the frame 321 is a pair of trolleys 322, one located on each side of the frame. A similar pair of trolleys 323 is fixed at the bottom of the frame 321. Each of the four trolleys 322 and 323 carries a pair of wheels 322*a* and 323*a* respectively, each wheel being rotatable on an axle, 322*b* and 323*b* respectively, that is essentially horizontal, or perpendicular with respect to the direction of orientation of the elongated housing 320 (FIG. 24). The wheels 322*a* and 323*a* are situated so that one wheel on each trolley 322 and 323, respectively, extends beyond the back edge of the frame 321, i.e., the edge of the frame away from the interior of the derrick, and the other wheel extends beyond the front edge of the frame. The frame 321 and the wheels 322*a* and 323*a* are used in conjunction with vertical movement of the pipe racker, as will be described.

Figure 25:
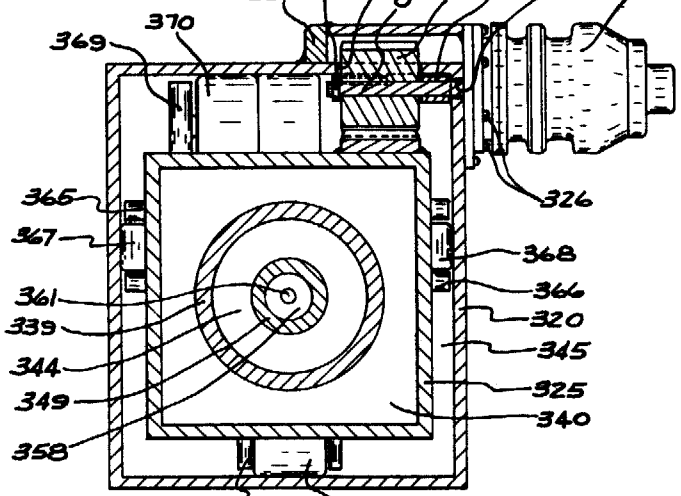
FIG. 25 is a partial cross-section taken along line 25—25 of FIG. 24.

An arm 325 is telescoped in the housing 320. A rack and pinion assembly is powered by a motor M', operable either by fluid pressure or electricity, mounted by bolts 326 on the outside of the housing 320 (FIGS. 24 and 25). The output shaft O' of the motor M' extends through a hole 320a in the housing 320, and a pinion 327 is fixed to the shaft between bearings 328 and 329. A hood 330 covers the pinion 327 and a housing opening 320*b* which accomodates the size of the pinion.

A rack 331, with which the pinion 327 is meshed, is fixed to the top of the arm 325, parallel to the elongated arm. Activation of the motor M' to rotate the output shaft O' turns the pinion 327, and drives the rack 331 and attached arm 325 into or out of the housing 320, i.e., either away from or toward the interior of the derrick, depending on the selected direction of rotation of the output shaft by the motor.

An alternative method of powering and telescoping action of the arm 325 with respect to the housing 320 is also provided. A circular cylinder 339 is positioned concentrically within the arm 325, and is fixed thereto by a base plate 340 at the back of the arm, and by a double-flanged end plate 341 at the front end of the arm. The inner flange of the end plate 341 is welded to the arm 325, and a brace 342 is held to the outer flange by nuts and bolts 343. The brace 342 connects the pipe gripping device, shown generally at G, to the end plate 341 and, therefore, to the arm 325.

As described hereinbefore in conjunction with the embodiment shown in FIG. 6, the back end of the cylinder 339, beyond the base plate 340, is closed by a plug 344 (FIG. 26) appropriately sealed to the cylinder against fluid pressure. The plug 344 also limits the telescoping movement of the arm 325 into the housing 320 by contacting, at the extreme of this movement, a housing end plate 345, which is held across the back of the housing 320 by bolts 346. A hollow shaft 349, passes through a hole in the plug 344, and is slidably, fluid-pressure sealed within the hole (not shown).

The shaft 349, which passes along the interior of the cylinder 339, is connected, through a universal joint shown at 352, to a piston head 353 slidably sealed to the cylinder by a packing seal 354 set in an outer annular groove 355 in the piston head. The back end of the shaft 349 in FIG. 24 passes through a central hole 345*a* in the housing end plate 345, and is threadedly joined to a cap 358 outside the housing 320. The cap 358, which is held to the housing end plate 345 by a partial cover 359 threadedly engaged to a ring 360 which is welded to the end plate, prevents movement of the shaft 349 into or out of the housing 320.

Fluid pressure may be introduced into the shaft 349 through a fluid pressure connector 361 in the cap 358. The fluid pressure so introduced is communicated throughout the interior of the cylinder 339, between the plug 344 and the piston head 353, through ports 362 at the far end of the shaft 349. This volume within the cylinder increases with such fluid pressure, driving the cylinder 339 and the attached arm 325 into the housing 320. Another fluid pressure connector 364 in the end plate 341 of the cylinder 339 beyond the piston head 353 allows the introduction of fluid pressure into the cylinder between the piston head and the pipe gripper brace 343 to drive the cylinder and arm 325 out of the housing 320. Thus, as in the previous embodiment hereinbefore described in relation to FIGS. 5 to 9, the telescoping motion of the arm 325 with respect to the housing 320 may be powered by operating the piston head 353 and shaft 349 along with the cylinder 339 as a fluid pressure piston-cylinder combination. This feature is in addition, or as an alternative, to the rack 331 and pinion 327 mechanism powered by the motor M' for powering the telescoping motion of the arm 325.

In the telescoping motion, the arm 325 rides along the housing 320 on a series of rollers. Two pairs of brackets 365 and 366, mounted on opposite sides of the exterior of the cylinder 339 behind the arm base plate 340, each hold a roller and axle 367 and 368 respectively to roll along the interior of the elongated side walls of the housing 320. Another pair of brackets 369, mounted on the base plate, holds three rollers on an axle 370 to ride along the interior of the upper wall of the housing 320. A single roller 371 is held on an axle by a pair of brackets 372, mounted on the base plate 340 and the bottom of the cylinder 339, to ride along the interior of the lower wall of the housing 320. Another set of rollers, extending from the vertical frame 321, guides and supports the arm 325 at the opening of the housing 320. As seen in FIG. 24, brackets 373 hold rollers 374 on an axle to contact the top of the arm 325, and brackets 375 similarly hold rollers 376 to support the arm from the bottom. Rollers 377 and 378, held on axles by brackets 379 and 380 respectively, contact the elongated sides of the arm 325 as indicated in FIG. 27.

Figure 27:
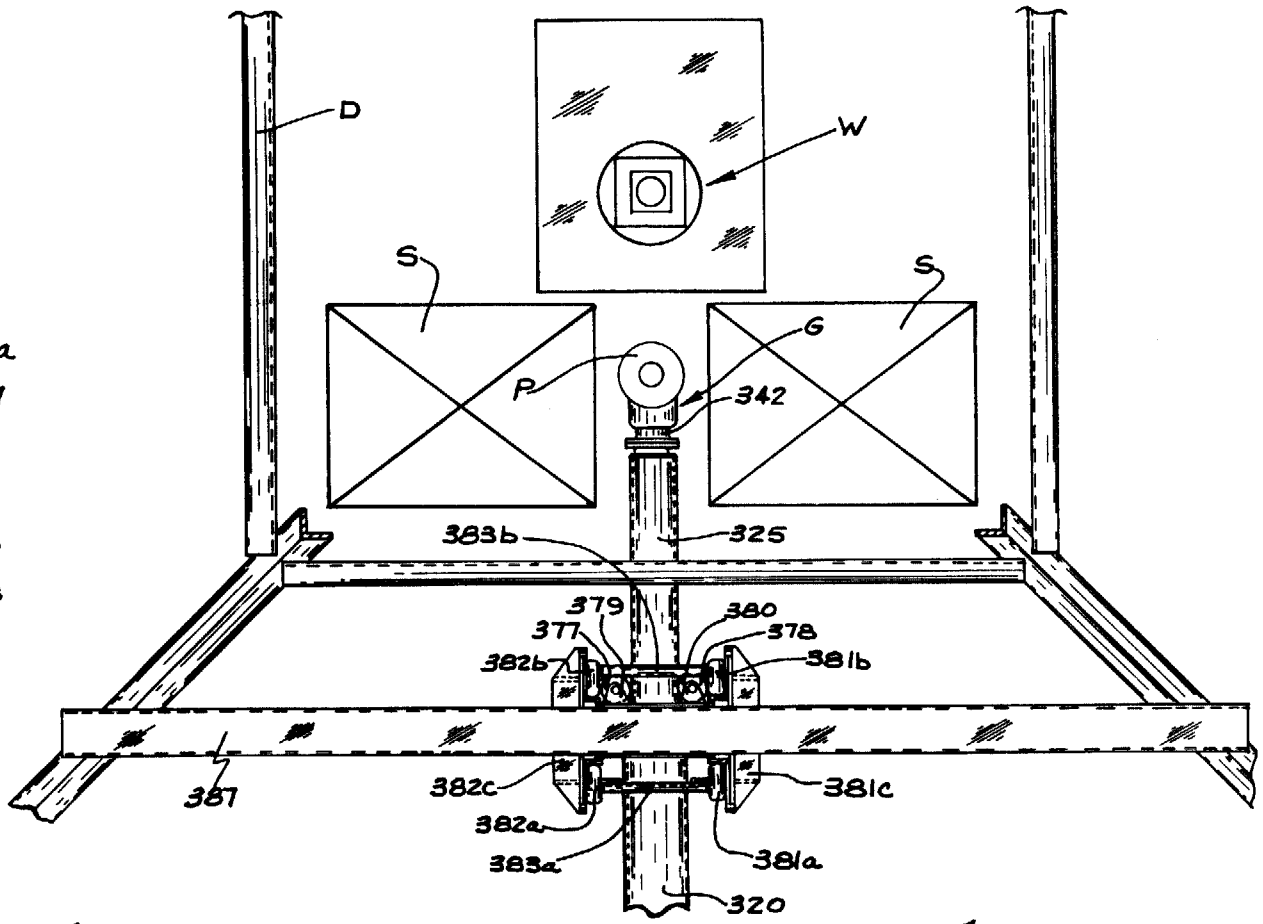
FIG. 27 is a plan view, partially schematic, of the racker arm shown in FIGS. 24 to 26 mounted in a different embodiment of a track system.
Figure 30:
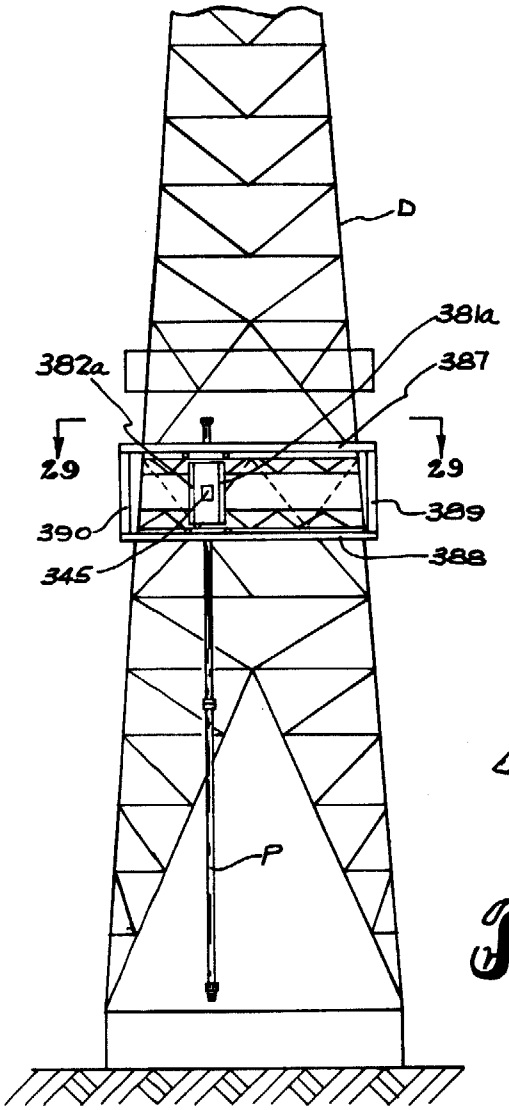
FIG. 30 is a transverse elevation schematically showing the pipe racker mounted on a derrick.
Figure 29:
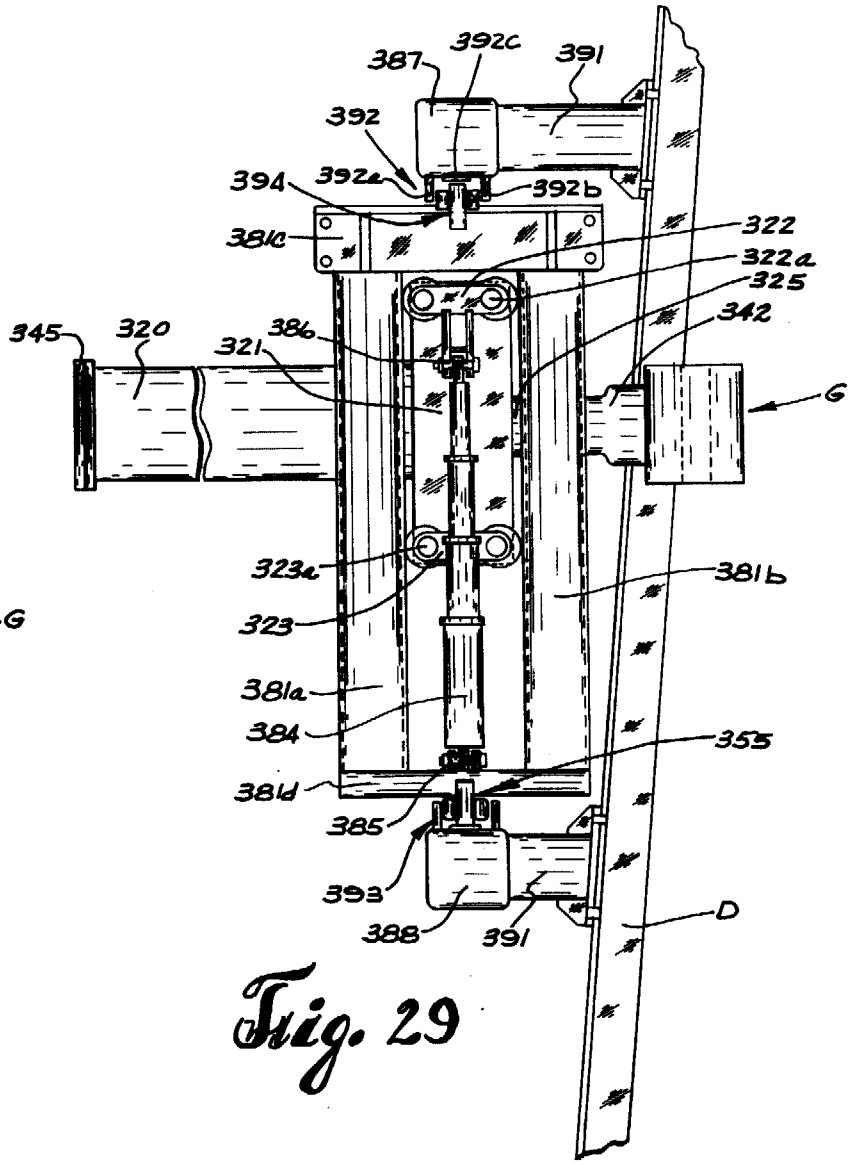
FIG. 29 is a side elevation, partially schematic, similar to FIG. 28, showing the racker arm in a raised position.
Figure 28:
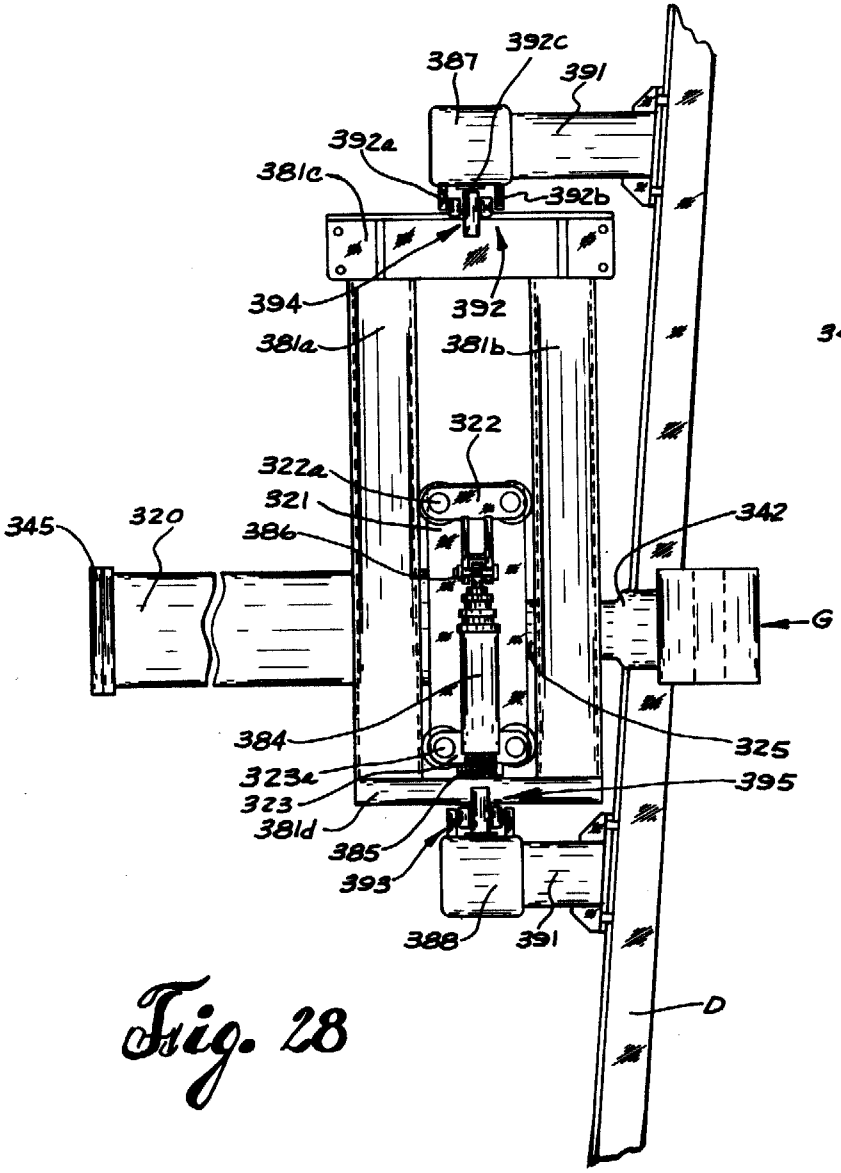
FIG. 28 is a side elevation, partially schematic, of the pipe racker shown in FIG. 27.

FIGS. 27 to 29 illustrate how the housing 320 and arm 325 are movable vertically while maintaining their horizontal attitude. The vertical frame 321 rides, on its wheels 322*a*, and 323*a*, along a horizontal carriage assembly composed primarily of four vertical tracks 381*a*, 381*b* and 382*a*, 382*b*, arranged on opposite sides of the housing 320 and arm 325 as shown. Cross-ties 381*c* and 381*d* complete the track system on one side (FIGS. 28 and 29). Corresponding cross-ties 382*c* and 382*d* (not visible) are similarly employed on the other side. Lateral braces 383*a* and 383*b* connect the two vertical track systems together at the top; a similar pair of lateral braces (not shown) ties the vertical track systems together at the bottom.

A four-stage telescoping fluid pressure cylinder system 384 is mounted on the cross-tie 381*d* by a pin and clevis 385 between the two vertical tracks 381*a* and 381*b*. The other end of the fluid pressure cylinder system 384 is mounted by a pin and clevis 386 to the side of the vertical frame 321 just below the upper trolley 322. A similar fluid pressure cylinder system 384' (not visible) joins the cross-tie 382*d* (not visible) to the vertical frame 321 on its other side. Both cylinder systems 384 and 384' are simultaneously operable from a common fluid pressure source (not shown) to selectively elevate the vertical frame 321 and, with it, the arm 325, the pipe gripping device G, and any pipe member P engaged by the pipe gripping device. The frame 321 is selectively lowered by release of the fluid pressure in the cylinder systems 384 and 384'.

A rectangular frame constructed with an upper horizontal box beam 387, a lower horizontal box beam 388 and two vertical box beams 389 and 390 (FIG. 30) is mounted on the derrick D by four braces 391 (only two visible) (FIGS. 28 and 29). This entire frame in turn supports the pipe racker, and the horizontal box beams 387 and 388 carry track systems for horizontal movement of the pipe racker along the frame. The upper horizontal beam 387 carries, on its underside, a track system, shown generally at 392, including two rails, 392*a* and 392*b*, and a horizontal raceway 392*c*. A similar track system shown generally at 393 is located on the topside of the lower horizontal box beam 388. An assembly of rollers mounted on appropriate axles and brackets, shown generally at 394, is fixed to each of the upper cross-ties 381*c* and 382*c* (not visible) so that, in each such assembly, rollers ride along each of the two rails, 392*a* and 392*b*, and along the raceway 392*c*. Similar assemblies, shown generally at 395, are fixed to the lower cross-ties 381*d* and 382*d* (not visible) to maintain rollers in contact with each of the two rails and with the raceway of the track system shown at 393. A suitable powering means (not shown), operates either by fluid pressure or electricity, is applied to selectively drive the pipe racker horizontally along the track systems at 392 and 393.

The pipe racker described in relation to FIGS. 24 to 30 is capable of transporting pipe members P, engaged by the pipe gripping device shown at G, vertically by means of the fluid pressure cylinder systems 384 and 384', toward and away from the interior of the derrick D by means of the telescoping action of the arm 325 with respect to the housing 320, activated either by the rack 331 and pinion 327 mechanism or by the fluid pressure cylinder 339 and piston head 353, and horizontally along the derrick side using the track systems at 392 and 393 located on the beams 387 and 388 respectively.

A derrick-mounted rectangular frame, similar to the one described in relation to FIGS. 24 to 30, is used to support the pipe racker embodiment illustrated in FIGS. 31 to 35. The same type of fluid pressure cylinder systems is used to effect vertical movement of the racker arm as well.

A vertical carriage assembly, shown generally at 420, including side plates 421*a* and 421*b*, a front plate 422, a back plate 423, and four cross-beams 424, supports the racker arm 425, and provides means for vertical movement of the arm. The racker arm 425 is in the form of a box beam, passing through appropriate holes 422*a* and 423*a* in the vertical carriage front and back plates, 422 and 423, respectively. Four pairs of free-running wheels permit the arm 425 to be moved back and forth within the vertical carriage 420. The arm 425 is supported from the bottom by wheels 426 on an axle 427, and wheels 428 on an axle 429. Wheels 430 on an axle 431, and wheels 432 on an axle 433 ride along the top of the arm 425. The wheels 426, 428, 430 and 432 are fitted with outer flanges 426*a*, 428*a*, 430*a* and 432*a*, respectively, that ride along the sides of the arm 425, keeping the arm properly positioned and oriented horizontally. The wheels 426 and 432 are larger than the wheels 428 and 430, since these larger wheels must bear the torque load exerted by the arm 425 about an axis through the points of contact between the wheels 426 and the arm when the arm is supporting pipe.

Figures 31, 32, 33:
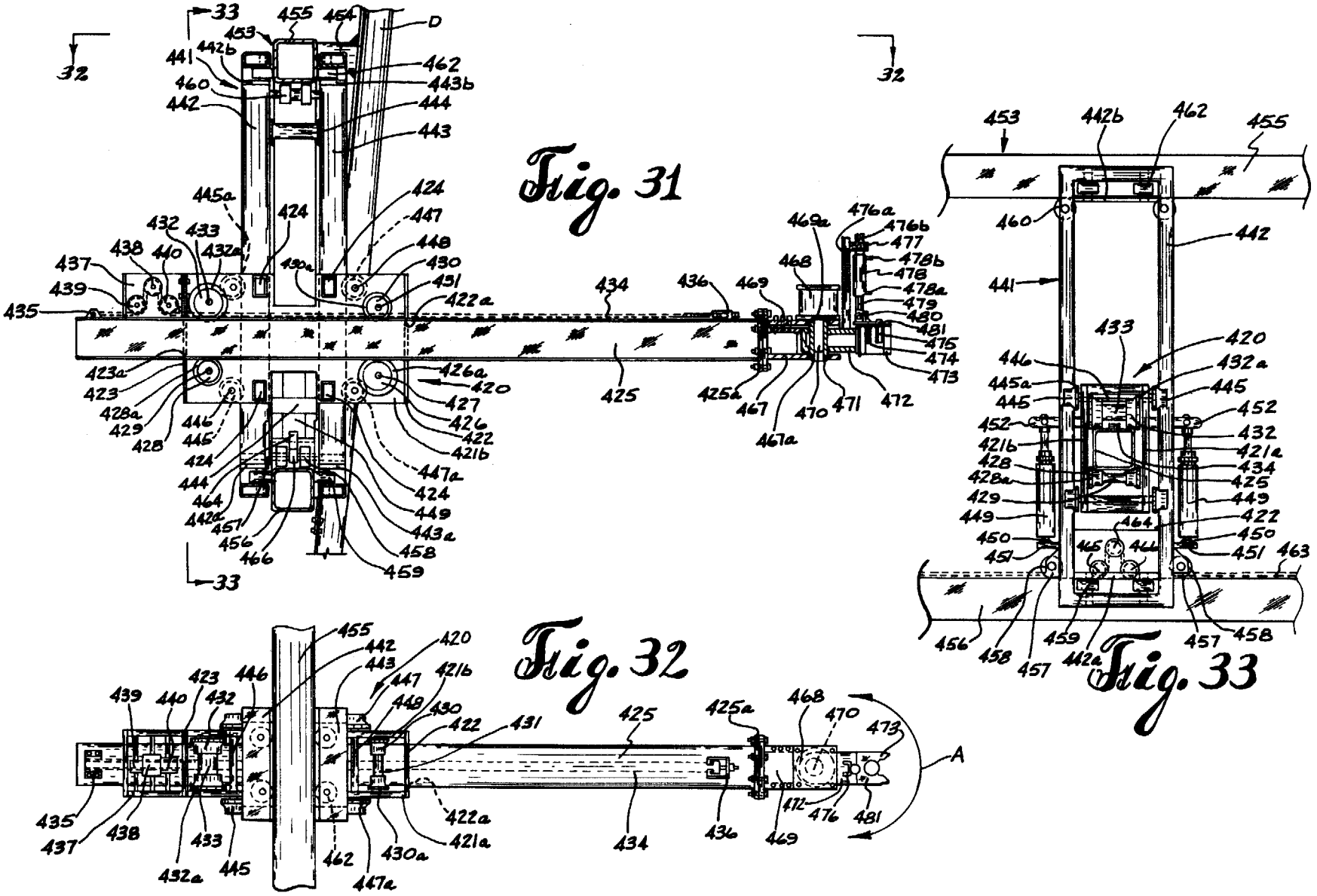
FIG. 31 is a side elevation, in partial section, of another pipe racker embodiment, featuring a rotatable pipe gripping device.
FIG. 32 is a partial plan view of the pipe racker shown in FIG. 31.
FIG. 33 is a partial transverse elevation of the pipe racker.

A racker arm drive chain 434 is stretched along the top of the arm 425 from a chain anchor 435 at the back of the arm to an adjustable chain tensioner 436 at the front end of the arm, i.e., the end toward the interior of the derrick D. A racker arm drive unit 437 is bolted to the back plate 423. The drive unit 437 contains a drive wheel 438 and two idler wheels, 439 and 440, each faced so as to positively engage the drive chain 434 and mounted on appropriate axles. The drive chain 434 passes over the drive wheel 438, and around the idler wheels 439 and 440 which are arranged so as to effect substantial contact between the drive chain and the drive wheel, as shown in FIG. 31. A motor (not shown), operable either by fluid pressure or electricity, is positioned on the drive unit 437 to rotate the drive wheel 438. Rotation of the drive wheel 437 draws the drive chain 434, kept tight by the tensioner 436, over the drive wheel, which in turn pulls the racker arm 425 forward or backward through the vertical carriage assembly 420 as determined by the direction of rotation of the drive wheel. In this way, the racker arm 425 may be selectively moved toward or away from the inner area of the derrick D.

A horizontal carriage assembly shown generally at 441 is constructed primarily of two rectangular frames made from box beams, 442 and 443. The two frames 442 and 443 are joined together by four horizontal cross-beams 444 (only two are visible). The vertical carriage 420 is equipped with two pairs of wheels to ride on each of the two frames, 442 and 443, as the vertical carriage and the arm 425 are raised and lowered. Wheels 445, on axles 446, ride along the vertical portions of frame 442; wheels 447, on axles 448, ride along the vertical portions of frame 443. The wheels 445 and 447 are fitted with flanges, 445*a* and 447*a* respectively, that ride along the inside of the vertical portions of the frames 442 and 443 respectively, guiding the vertical movement of the vertical carriage 420, and maintaining its vertical orientation. On both sides of the vertical carriage 420, a four-stage fluid pressure cylinder system 449 is fixed by a clevis and pin 450 to a bar 451 joined to the two frames 442 and 443 near their bottoms. The other end of each fluid pressure cylinder system 449 is mounted by a pin and clevis 452 to the corresponding side plate 421*a* or 421*b* of the vertical carriage 420. Both cylinder systems 449 are simultaneously operable from a common fluid pressure source (not shown) to selectively elevate the vertical carriage 420 and the arm 425. The vertical carriage 420 and arm 425 are selectively lowered by release of the fluid pressure in the cylinder systems 449.

A rectangular frame of box beams, shown generally at 453, is mounted on the derrick D by braces 454 (only one visible), and provides vertical support to the pipe racker as well as a means for horizontal movement along the side of the derrick. The frame 453 includes an upper horizontal box beam 455 and a lower horizontal box beam 456 which act as tracks along which the horizontal carriage assembly 441 may be moved. Brackets 457 at the base of the horizontal carriage 441 hold wheels 458 that ride along the top of the lower beam 456, thereby supporting the horizontal carriage. Rollers 459, mounted on the bottom of the horizontal carriage assembly 441 between the lower horizontal portions of the rectangular frames, 442 and 443, and the cross bars 442*a* and 443*a* respectively, on either side of the lower beam 456, ride along the sides of the lower beam, restraining the horizontal carriages from deviating laterally from the lower beam. A similar arrangement connects the top of the horizontal carriage 441 to the upper box beam 455. Wheels 460, mounted on the vertical portions of the rectangular frames 442 and 443, roll along the bottom of the upper beam 455, and rollers 462, mounted between the upper horizontal portions of the rectangular frames, 442 and 443, and the cross bars 442*b* and 443*b* respectively, contact the two sides of the upper beam, preventing the pipe racker from tilting.

A horizontal carriage drive chain 463 is stretched along the top of the lower beam 456, and fixed at one end by a chain anchor (not shown), and at the other by an adjustable chain tensioner (not shown), as in the case of the chain 434, anchor 435, and tensioner 436 on the racker arm 425. A drive wheel 464 and two idler wheels, 465 and 466, each faced so as to positively engage the drive chain 463, are mounted on appropriate axles within the bottom area of the horizontal carriage 441, just above the lower beam. The drive chain 463 passes over the drive wheel 464 and around the idler wheels 465 and 466, which are positioned to effect substantial contact between the drive wheel and the drive chain, as best seen in FIG. 33. A motor (not shown), operable either by fluid pressure or electricity, is positioned on the horizontal carriage 441 to rotate the drive wheel 464. Rotation of the drive wheel 464 draws the drive chain, kept tight by its tensioner (not shown), over the drive wheel 463, which in turn pulls the horizontal carriage assembly 441, and the rest of the pipe racker back and forth along the derrick mounted frame 453. In this way, the racker arm 425 may be selectively moved parallel to the side of the derrick D on which the pipe racker is mounted.

The front of the racker arm 425, i.e., the part extending within the derrick D, ends in a flange 425*a* to which is bolted a short box beam 467 serving as a brace to support the pipe gripping device. A rotary motor 468, hydraulically or electrically powered, is fixed to a plate 469, which is bolted to the top of the box beam 467. An output drive shaft 470 extends downwardly from the motor 468. A hollow cylinder 471 is fixed to, and rotates with, the drive shaft 470. Both the drive shaft 470 and the cylinder 471 pass through a circular hole 469a in the plate 469, and a hole 467*a* in the bottom of the brace 467. Appropriate bearing material (not shown) may be used to line these holes 469*a* and 467*a* to maintain proper orientation of the cylinder 471 and shaft 470.

The cylinder 471 passes through holes in a short box beam 472, and is welded thereto, within the brace 467. The far end of the box beam 472 is welded to the pipe gripping device body 473. The pipe gripping device is used to selectively grip pipe members as hereinafter described in detail. The rotary motor 468 is used to rotate the pipe gripping device in a substantially horizontal plane, as indicated by the arc A in FIG. 32, to permit gripping or release of pipe members at a wide range of angles. This feature is particularly useful when the pipe racker arm 425 is placing a pipe member within a fingerboard F (FIGS. 1 to 4), or retrieving a pipe member therefrom.

Figures 34, 35, 39:
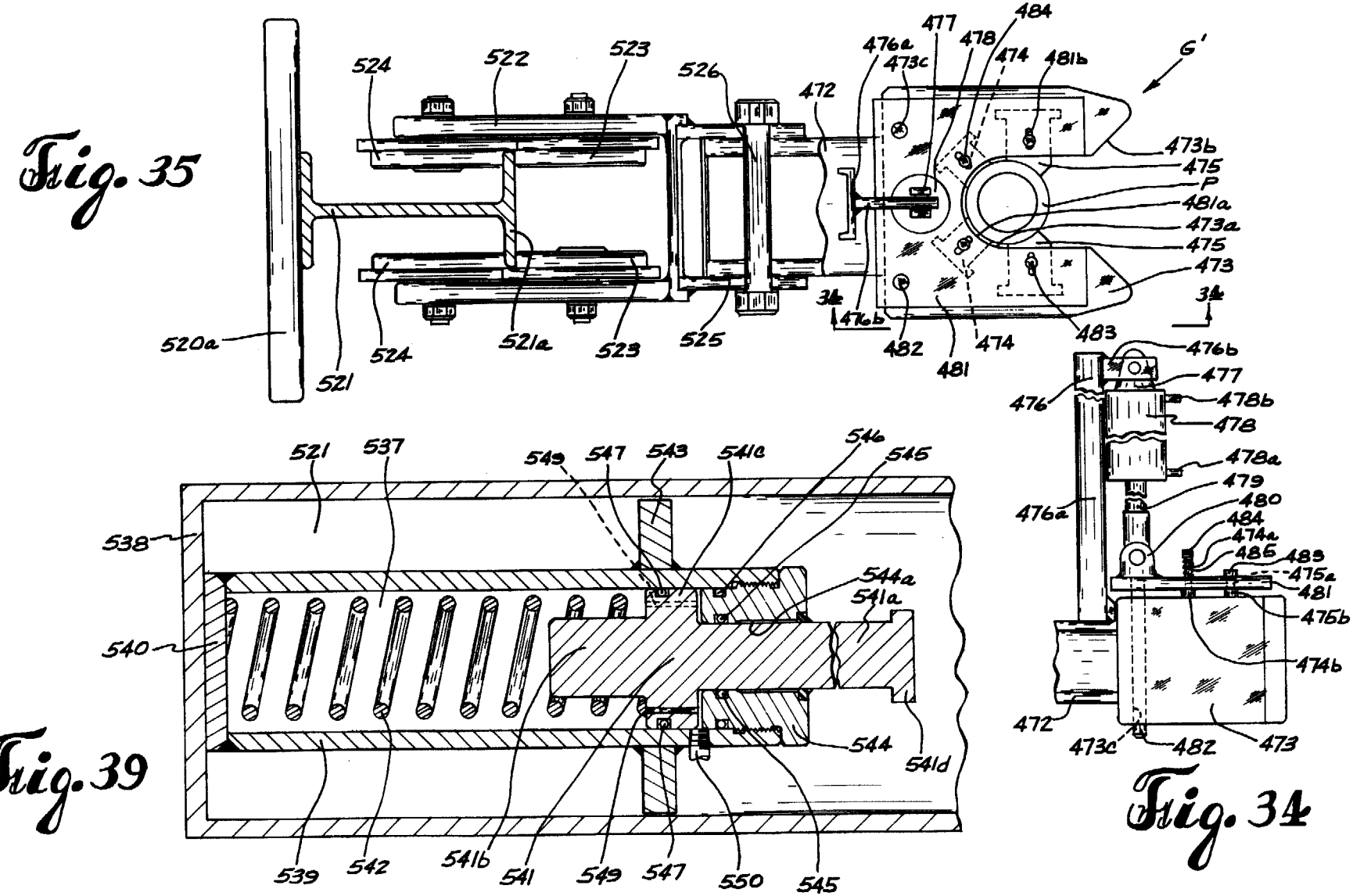
FIG. 34 is a side elevation of the pipe gripping device.
FIG. 35 is a plan view of the pipe gripping device illustrated in FIG. 34, mounted on the trolley shown in FIGS. 36 to 38.
FIG. 39 is an elevation in cross-section of the shock absorber of the drill collar racker.

As best seen in FIGS. 34 and 35, the body 473 possess a U-shaped recess 473*a*, having a cylindrically circular curvature on its innermost surface to accommodate a pipe member P, and bevelled outer surfaces 473*b* to facilitate the insertion of the pipe member into the recess. The body 473 holds, in slanted dove-tail unions (not shown) four slip dies, each with a cylindrically curved face to accommodate pipe surfaces. Two slip dies 474, located at the innermost section of the recess 473*a*, are faced with the same type horizontal grooves and edges for pipe gripping as described above in relation to slip dies 86 in FIGS. 9 and 10, 191 and 192 in FIGS. 15 and 16, and 265 in FIG. 18. Along each side of the recess 473*a* is a smooth-faced slip die 475. As in the case of the smooth-faced slip dies 268 in FIGS. 18 and 19, the slip dies 475 are angled, as seen in FIG. 35, to enclose a pipe member P inserted within the recess 473*a*, forcing the pipe member against the pipe-gripping slip dies 474.

A bracket, 476, formed with a channel beam 476*a* and a cross-beam 476*a*, is welded to the top of the box beam 472. The cross beam 476*b* is attached, by a clevis and pin 477, to the cylinder 478 of a fluid pressure piston-cylinder assembly. The piston arm 479 extends downwardly from the cylinder 478, and is attached by a clevis and pin 480 to a lifting plate 481. The cylinder 478 is fitted with a fluid pressure connector 478*a* that permits introduction of fluid pressure below the piston head (not shown) on the piston arm 479 to drive the piston arm, and the attached lifting plate 481, upwardly. Introduction of the fluid pressure into the cylinder 478 through a fluid pressure connector 478*b* above the piston head drives the piston arm 479, and the attached lifting plate 481, downwardly. Two guide rods 482 extend downwardly from the lifting plate 481, and move up and down, with the plate, within through-bores 473*c* in the body 473. The guide rods 482 maintain the lifting plate 481 in proper attitude with respect to the body 473 throughout the vertical motion of the plate.

The lifting plate 481, which is generally rectangular with a U-shaped recess 481*a* that matches the body recess 473*a*, is equipped with four slots 481*b*. Rods extend upwardly from the four slip dies: a long rod 474*a* from each of the slip dies 474; and a shorter rod 475*a* from each of the slip dies 475. Each short rod 475*a* passes through a slot 481*b* in the lifting plate 481, and is fitted with a shoulder 475*b* below the plate, and a nut 483 above the plate, both larger than the slot width, thereby constraining the slip die to move up and down with the plate. Similarly, each of the long rods 474*a* passes through a lifting plate slot 481*b*, is fitted with a shoulder 474*b* below the plate 481, and a nut 484 above the plate. However, a coil spring 485 encompasses each rod 474*a* between the lifting plate 481 and the nut 484, biasing the slip die 474 upwardly toward the lifting plate. Therefore, although each slip die 474 is generally constrained by the corresponding rod shoulder 474*b* and nut 484 to move up and down with the lifting plate 481, the spring linkages between the two rods 474*a* and the lifting plate permit the slip dies to be lowered, with respect to the plate, under the influence of the weight of a pipe member gripped by the slip dies.

It will be appreciated that, as in the previous description of slip dies 86, 191, 192, and 265, the slip dies 474 grip the pipe member P, inserted within the recess 473*a* and held there by the smooth-faced slip dies 475. As in the case of the slip dies 268, the smooth-faced slip dies 475 are used to selectively block a pipe member P from emerging from the recess 473*a*, the pipe member being held between these slip dies and the gripping slip dies 474. To remove a pipe member P from the recess 473*a*, or to insert one, the lifting plate 481 is used to raise the slip dies 475 along their slanted dove-tail unions with the body 473, drawing the slip dies away from the recess until the opening is large enough to permit passage of the pipe member therethrough. As the body 473 is raised with respect to an enclosed pipe member P, the relative downward drag by the pipe member on the gripping slip dies 474 urges these slip dies downwardly. The slant of the dove-tail unions between the slip dies 474 and the body 473 results in a wedging effect whereby the slip dies 474 are tightened against the pipe member P. The length of the slots 481 permits the necessary lateral movement of the rods 474*a* and 475*a* as the slip dies 474 and 475 respectively ride along their respective slanted dove-tail unions.

The pipe gripping device, with body 473, in the embodiment shown in FIGS. 31 to 35, is afforded vertical motion by action of the fluid pressure cylinder assemblies 449 operating on the vertical carriage assembly 420, and horizontal motion along one side of the derrick D by powered rotation of the drive wheel 464 to pull the horizontal carriage assembly 441 along the derrick-mounted beams 455 and 456. Motion toward and away from the interior area of the derrick D is provided by powered rotation of the drive wheel 438 to pull the racker arm 425 one way or the other through the vertical carriage assembly 420. The rotational motion of the pipe gripping device about the arc A (FIG. 32) completes the selective motion capability of the pipe racker.

Another racker, specially designed to manipulate drill collars, is illustrated in FIGS. 35 to 39. A racker arm 520 is supported by a derrick-mounted assembly (not shown) that provides selectively powered motion of the arm in a substantially horizontal plane over the area required for manipulation of the drill collar. Any of the assemblies described hereinbefore to provide such motion may be employed with the arm 520. The derrick end of the arm 520 is fitted with a cross piece 520*a* to which is attached, perpendicularly to the arm, a substantially vertical track assembly constructed primarily of an I-beam 521. The flange piece 521*a* of the I-beam 521, positioned opposite the arm 520, serves as a rail for a trolley 522. On both sides of the I-beam 521, the trolley 522 is fitted, via appropriate axles, with wheels 523 that ride along the outer side of the I-beam flange 521*a*, and wheels 524 that ride along the inner side of the flange. The trolley supports a brace 525 to which is attached a pipe gripping device G' of any type described hereinabove, but of a size to render it capable of engaging and lifting drill collars of larger diameters than drill pipe members. As an illustration, in FIG. 35, the trolley 522 is shown supporting, by bolts 526 (only one visible) the pipe gripping device G' which is constructed and operates in the manner previously described in relation to the pipe racker embodiment in FIGS. 31 to 35.

Figures 36, 37, 38:
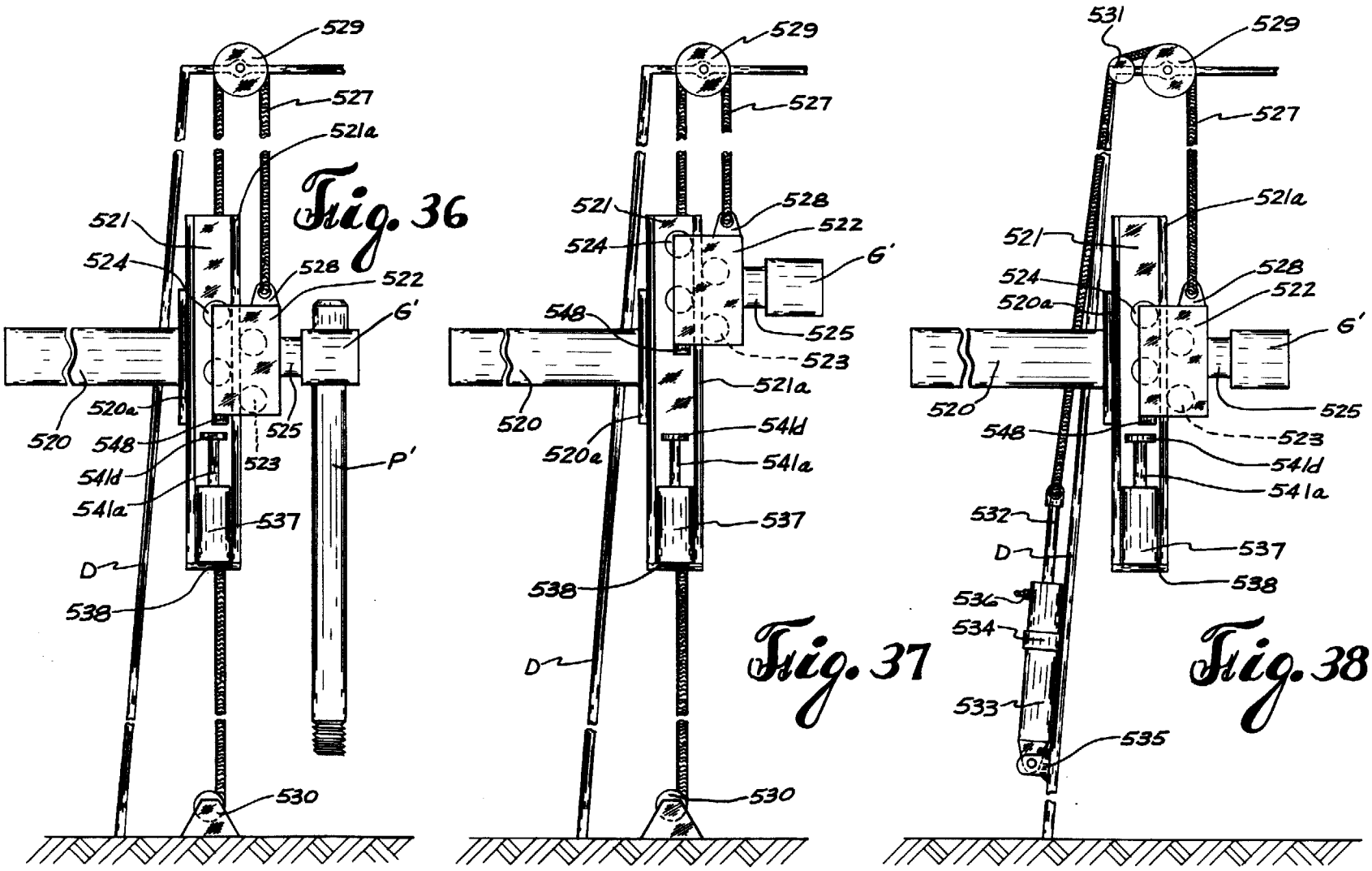
FIG. 36 is a side elevation, partially schematic, of a cable-assisted racker designed specifically to manipulate drill collars.
FIG. 37 is a side elevation, partially schematic, similar to FIG. 36, showing the trolley and gripping device in a raised position.
FIG. 38 is a side elevation, partially schematic, of the racker shown in FIGS. 37 and 38, but with the cable lift powered by a fluid pressure cylinder.

A cable 527 is attached to the trolley 522 by a bracket 528. The cable 527 passes over a sheave 529 mounted higher in the derrick D, and down to an air winch 530 located at the base of the derrick (FIGS. 36 and 37). The trolley 522 is thus supported by the cable 527 and selectively raised (FIG. 37) and lowered along the I-beam 521 by operation of the air winch winding up or releasing the cable.

In FIG. 38, a second sheave 531 is used to pass the cable 527 to the outside of the derrick D where, at a point near the base of the derrick, the cable is attached to a piston arm 532. An associated fluid pressure cylinder 533 is mounted on the derrick D by a bracket 534 and by a clevis and pin assembly 535. Introduction of fluid pressure into the cylinder 533 through a fluid pressure connector 536 above the piston head (not shown) which is attached to the piston arm 532 pulls the cable 522 toward the fluid pressure cylinder, raising the trolley 522 and the gripping device G'. Release of the fluid pressure from the cylinder 533 permits the trolley 522 and the gripping device G' to drop. It will be appreciated that, while only two methods of rigging the cable in the derrick are shown, the number and placement of the sheaves may be modified, and even a dead man added, to provide any arrangement which places the bulk of the drill collar load ultimately on the derrick rather than on the racker.

Two shock absorber systems 537 are included on the I-beam 521 to reduce the magnitude of the possible impact on the pipe racker and the cable 527 when the trolley 522 and gripping device G' are lowered with a heavy drill collar engaged. FIG. 39 illustrates a shock absorbing system 537 in detail. A bottom plate 538 is welded to the I-beam 521, and supports a shock absorber system 537 on each side of the I-beam, between the I-beam flanges (only one shock absorber system 537 is visible). Each shock absorber system 537 is primarily a cylinder 539, with a closed bottom 540, a piston 541, and a coil spring 542, positioned within the cylinder so as to urge the piston upwardly. The cylinder 539 is held in place against the flanges of the I-beam 521 by two braces 543. A plug 544, with a through bore 544*a*, is threadedly connected to the cylinder 539. The piston 541 is positioned with its shank 541*a* in the through-bore 544*a*, and is slidably sealed therein by an O-ring seal 545. The plug 544 is sealed to the cylinder 539 by an O-ring seal 546. The cylinder 539, plug 544 and piston 541 form essentially a closed chamber. The piston tail 541*b* is encircled by the spring 542. An annular piston shoulder 541*c* separates the piston shank 541*a* from the piston tail 541*b*, and compresses the spring 542 against the cylinder bottom 540. The piston shoulder 541*c* is slidably sealed to the cylinder by an O-ring seal 547. At the top of the shank 541*a*, the piston 541 widens into a seat 541*d*.

As the trolley 522 is lowered by the cable 527, a shoe 548 on the bottom of each side of the trolley contacts the seat 541d of the corresponding shock absorber system 534, driving the piston 541 down into the cylinder 534 and compressing the spring 542. The compression of the spring 542 slows the descent of the trolley 522, gripping device G', and drill collar P' engaged therein. Additional shock absorbing is provided by oil, which fills the cylinder 539, impeding the movement of the piston 541 within the cylinder. The retardation of the downward movement of the piston 541 through the oil is due to the hydrodynamic drag on the piston as well as the tendency of the piston to compress the oil in a decreasing volume within the cylinder 539 below the piston shoulder 541*c*. Since the oil has low compressibility, narrow through-bores 549 (two are indicated in FIG. 39) in the piston shoulder 541*c* are used to permit passage of the oil to the top side of the piston shoulder 541*c*. When the trolley 522 is raised and the load removed from the piston 541, the piston is urged upwardly by the spring 542, and the shoulder 541*c* again moves through the oil, with oil flowing back down the through-bores 549. A fluid connector 550 communicates oil between the interior of the cylinder 539 and an external oil reservoir (not shown) to maintain the oil pressure in the cylinder constant as the piston 541 is driven in and out of the plug 544.

In addition to the powered horizontal motion afforded the drill collar gripping device G' as mentioned hereinbefore, the cable 527 and the air winch 530, or piston 532 and cylinder 533, provide substantially vertical motion to the trolley 522 along the I-beam 521 to lift the drill collar P' or set it down. The shock absorber assemblies 537 operate to cushion the downward motion of the trolley 522 and drill collar P' relative to the racker.

The derrick-mounted pipe racker embodiments described herein may be considered in terms of the functions performed by their different parts. There are four essential functions performed in the case of each embodiment: the gripping of a pipe member, or drill collar, by the gripping device; telescoping motion of the racker arm, whereby the gripping device is generally moved deeper into the derrick interior, or withdrawn therefrom; vertical motion of the gripping device by tilting the racker arm, raising the racker arm while maintaining it essentially horizontal, or, in the case of drill collar manipulation, lifting the gripper by a cable; and horizontal motion of the gripping device, generaly to one side or the other of the derrick interior, either by swiveling the racker arm, or by moving the entire racker arm along a track system mounted on the derrick. In addition to these operations, a rotational motion with respect to the racker arm in an essentially horizontal plane may be imparted to the gripping device. All of these functions are designed to accomplish the maneuvering of pipe members (or drill collars) within the derrick, generally between storage areas and the well. It will be appreciated that any embodiment of the pipe racker as a whole may employ any combination of the different embodiments to perform the specified functions, with the exception that the cable lift embodiment for vertical motion is to be used for drill collars in conjunction with the shock absorber systems described hereinbefore.

The foregoing disclosure and description of the invention is illustrative and explanatory thereof, and various changes in the size, shape and materials as well as in the details of the illustrated construction may be made within the scope of the appended claims without departing from the spirit of the invention.

I claim:

1. A pipe manipulating system comprising:

a. generally tubular housing means;

b. arm means mounted in and constrained by said housing means, and longitudinally extendable and retractable with respect to said housing means;

c. pipe gripping means mounted on, and movable with, said arm means;

d. slip means included in said pipe gripping means;

e. first power means comprising fluid pressure means to advance and retract said slip means to selectively engage and support, or release, said pipe;

f. mounting means supporting said housing means, and providing substantially vertical and substantially horizontal movability to said housing means and to said arm means;

g. second power means to longitudinally extend and retract said arm means with respect to said housing means;

h. third power means to provide substantially vertical locomotion to said housing means and to said arm means; and i. fourth power means to provide substantially horizontal locomotion to said housing means and to said arm means.

2. A pipe manipulating system as defined in claim 1 wherein:

a. said mounting means comprises substantially horizontal track means;

b. said housing means is constrained by said substantially horizontal track means;

c. said housing means is movable along said substantially horizontal track means; and d. said fourth power means provides locomotion to said housing means and to said arm means to traverse along said substantially horizontal track means.

3. A pipe manipulating system as defined in claim 2 wherein:

a. said mounting means further comprises substantially vertical track means;

b. said housing means is constrained by said substantially vertical track means;

c. said housing means is movable along said substantially vertical track means; and d. said third power means provides locomotion to said housing means and to said arm means to rise and fall along said substantially vertical track means.

4. A pipe manipulating system as defined in claim 2 wherein:

a. said mounting means further comprises substantially horizontally oriented pivot means;

b. said housing means is constrained by said substantially horizontally oriented pivot means;

c. said housing means is rotatable, in a substantially vertical plane, about said substantially horizontally oriented pivot means; and d. said third power means provides locomotion to said housing means and to said arm means to rotate about said substantially horizontally oriented pivot means.

5. A pipe manipulating system as defined in claim 1 wherein:

a. said mounting means comprises substantially vertically oriented pivot means;

b. said housing means is constrained by said substantially vertically oriented pivot means;

c. said housing means is rotatable, in a substantially horizontal plane, about said substantially vertically oriented pivot means; and d. said fourth power means provides locomotion to said housing means and to said arm means to rotate about said substantially vertically oriented pivot means.

6. A pipe manipulating system as defined in claim 5 wherein:

a. said mounting means further comprises substantially horizontally oriented pivot means;

b. said housing means is constrained by said substantially horizontally oriented pivot means;

c. said housing means is rotatable, in a substantially vertical plane, about said substantially horizontally oriented pivot means; and d. said third power means provides locomotion to said housing means and to said arm means to rotate about said substantially horizontally oriented pivot means.

7. A pipe manipulating system as defined in claim 3 wherein said third power means includes fluid pressure cylinder means linking said housing means and said mounting means.

8. A pipe manipulating system as defined in claim 4 wherein said third power means includes fluid pressure cylinder means linking said housing means and said mounting means.

9. A pipe manipulating system as defined in claim 6 wherein said third power means includes fluid pressure cylinder means linking said housing means and said mounting means.

10. A pipe manipulating system as defined in claim 7 wherein said second power means comprises fluid pressure piston-cylinder means constructed within, and as a part of, said arm means whereby said arm means includes said second power means cylinder means, and said second power means piston means is anchored to said housing means.

11. A pipe manipulating system as defined in claim 8 wherein said second power means comprises fluid pressure piston-cylinder means constructed within, and as a part of, said arm means whereby said arm means includes said second power means cylinder means, and said second power means piston means is anchored to said housing means.

12. A pipe manipulating system as defined in claim 8 wherein said second power means comprises fluid pressure piston-cylinder means whereby said housing means comprises said second power means cylinder means and said arm means comprises said second power means piston means.

13. A pipe manipulating system as defined in claim 9 wherein said second power means comprises fluid pressure piston-cylinder means whereby said housing means comprises said second power means cylinder means and said arm means comprises said second power means piston means.

14. A pipe manipulating system as defined in claim 7 wherein said second power means includes rack-and-pinion means connecting said arm means to said housing means whereby relative locomotion of said arm means with respect to said housing means is effected.

15. A pipe manipulating system as defined in claim 10 wherein said second power means includes rack-and-pinion means connecting said arm means to said housing means whereby relative locomotion of said arm means with respect to said housing means is effected.

16. A pipe manipulating system as defined in claim 11 wherein said pipe gripping means comprises multiple gripping assembly means whereby said pipe may be engaged and released from more than one direction relative to said arm means.

17. A pipe manipulating system as defined in claim 3 wherein:

a. said second power means comprises first chain means connected to said arm means and first sprocket means on said housing means, engaging said first chain means;

b. said second power means provides locomotion to said arm means with respect to said housing means by rotating said first sprocket means;

c. said fourth power means comprises second chain means connected to said mounting means and second sprocket means on said housing means, engaging said second chain means; and d. said fourth power means provides locomotion to said housing means and to said arm means to traverse along said substantially horizontal track means by rotating said second sprocket means.

18. A pipe manipulating system as defined in claim 17 further comprising:

a. rotary joint means connecting said pipe gripping means to said arm means such that said pipe gripping means is rotatable, with respect to said arm means, about an axis that is substantially vertical; and b. fifth power means to rotate said pipe gripping means, about said axis, to selective directions with respect to said arm means.

19. A pipe manipulating system as defined in claim 18 wherein said third power means includes fluid pressure cylinder means linking said housing means and said mounting means.

20. A pipe manipulating system as defined in claim 1 wherein said second power means comprises fluid pressure piston-cylinder means constructed within, and as a part of, said arm means whereby said arm means includes said second power means cylinder means, and said second power means piston means is anchored to said housing means.

21. A pipe manipulating system as defined in claim 1 wherein said second power means comprises fluid pressure piston-cylinder means whereby said housing means comprises said second power means cylinder means and said arm means comprises said second power means piston means.

22. A pipe manipulating system as defined in claim 1 wherein said second power means includes rack-and-pinion means connecting said arm means to said housing means whereby relative locomotion of said arm means with respect to said housing means is effected.

23. A pipe manipulating system as defined in claim 1 wherein said pipe gripping means comprises multiple gripping assembly means whereby said pipe may be engaged and released from more than one direction relative to said arm means.

24. A pipe manipulating system as defined in claim 1 further comprising:

a. rotary joint means connecting said pipe gripping means to said arm means such that said pipe gripping means is rotatable, with respect to said arm means, about an axis that is substantially vertical; and b. fifth power means to rotate said pipe gripping means, about said axis, to selective directions with respect to said arm means.

* * * * *